US012557866B2

(12) United States Patent
Lebel et al.

(10) Patent No.: US 12,557,866 B2
(45) Date of Patent: Feb. 24, 2026

(54) RECONFIGURABLE HELMET

(71) Applicant: GALVION LTD., Portsmouth, NH (US)

(72) Inventors: Stéphane Lebel, Redempteur (CA); Richard Coomber, Beaconsfield (CA)

(73) Assignee: GALVION LTD., Portsmouth, NH (US)

( * ) Notice: Subject to any disclaimer, the term of this patent is extended or adjusted under 35 U.S.C. 154(b) by 0 days.

(21) Appl. No.: 18/834,694

(22) PCT Filed: Feb. 1, 2023

(86) PCT No.: PCT/US2023/061745

§ 371 (c)(1),
(2) Date: Jul. 31, 2024

(87) PCT Pub. No.: WO2023/150548

PCT Pub. Date: Aug. 10, 2023

(65) Prior Publication Data

US 2025/0151833 A1 May 15, 2025

Related U.S. Application Data

(60) Provisional application No. 63/306,369, filed on Feb. 3, 2022.

(51) Int. Cl.

| | |
|---|---|
| ***A42B 3/10*** | (2006.01) |
| ***A42B 3/06*** | (2006.01) |
| ***A42B 3/30*** | (2006.01) |

(52) U.S. Cl.

CPC ..... *A42B 3/10* (2013.01); *A42B 3/06* (2013.01); *A42B 3/061* (2013.01); *A42B 3/063* (2013.01); *A42B 3/30* (2013.01)

(58) Field of Classification Search

CPC .. A42B 3/10; A42B 3/06; A42B 3/061; A42B 3/063; A42B 3/30

See application file for complete search history.

(56) References Cited

U.S. PATENT DOCUMENTS

| | | | |
|---|---|---|---|
| 2,378,642 | A | 6/1945 | Kopplin |
| 2,452,999 | A | 11/1948 | Daly et al. |

(Continued)

FOREIGN PATENT DOCUMENTS

| | | | |
|---|---|---|---|
| CA | 1273175 | C | 8/1990 |
| CN | 1434282 | A1 | 8/2003 |

(Continued)

OTHER PUBLICATIONS

CA Examiner's Report corresponding to Application No. 3,167,174, dated Oct. 19, 2023, 6 pages (English Translation).

(Continued)

*Primary Examiner* — Khaled Annis
(74) *Attorney, Agent, or Firm* — DAY PITNEY LLP; George N. Chaclas

(57) ABSTRACT

A reconfigurable helmet and exemplary uses thereof are disclosed. The reconfigurable helmet includes a first portion that includes an outer shell and a second portion that includes a liner. The first portion can translate relative to a second portion to expose one or more functional layers for removal or replacement. A user can configure and reconfigure the helmet by adding, removing, or replacing one or more of the functional layers.

20 Claims, 15 Drawing Sheets

(56) References Cited

U.S. PATENT DOCUMENTS 2,468,697 A 4/1949 Wiley
2,666,951 A 1/1954 Grove
2,814,043 A 11/1957 Alesi
3,018,210 A 1/1962 Frieder et al.
3,154,788 A 11/1964 Simpson
3,264,392 A 8/1966 Taplin
3,349,153 A 10/1967 Rudolf
3,383,705 A 5/1968 Raschke
3,726,953 A 4/1973 Jones et al.
3,758,889 A 9/1973 Erb
4,023,209 A 5/1977 Frieder, Jr. et al.
4,130,803 A * 12/1978 Thompson ..... H04R 1/10 455/344
4,263,679 A 4/1981 Erlendson
4,449,787 A 5/1984 Burbo et al.
4,599,752 A * 7/1986 Mitchell ..... A42B 3/32 2/425
4,888,831 A 12/1989 Oleson
4,942,628 A 7/1990 Freund
4,943,222 A 7/1990 Nathoo
5,042,093 A 8/1991 Legendre
5,151,277 A 9/1992 Bernardon et al.
5,315,718 A 5/1994 Barson et al.
5,416,922 A 5/1995 Horvat et al.
5,551,094 A 9/1996 Navone
5,572,749 A 11/1996 Ogden
5,578,158 A 11/1996 Gutowski et al.
5,581,819 A 12/1996 Garneau
5,601,852 A 2/1997 Seemann
5,683,831 A 11/1997 Baril et al.
5,794,272 A 8/1998 Workman et al.
5,898,949 A 5/1999 Barthold et al.
5,940,889 A * 8/1999 Shirai ..... A42B 3/283 2/171.3
6,032,297 A 3/2000 Barthold et al.
6,081,931 A 7/2000 Burns et al.
6,263,514 B1 * 7/2001 Chern ..... A42B 3/30 2/425
6,292,952 B1 9/2001 Watters et al.
6,807,838 B2 10/2004 Iwaya
6,968,575 B2 11/2005 Durocher
6,981,863 B2 1/2006 Renault et al.
7,124,449 B2 10/2006 Sutter et al.
7,178,175 B2 2/2007 Rogers et al.
7,770,239 B1 8/2010 Goldman et al.
8,020,220 B2 9/2011 Mcelroy et al.
8,353,066 B2 1/2013 Rogers et al.
8,739,318 B2 6/2014 Durocher
8,826,463 B2 9/2014 Teetzel et al.
8,908,389 B2 12/2014 Teetzel et al.
8,984,665 B2 3/2015 Celona et al.
9,003,858 B1 4/2015 Lin et al.
9,101,175 B2 8/2015 Redpath et al.
9,216,523 B2 12/2015 Monforte, II et al.
9,247,779 B1 2/2016 Aloumanis et al.
9,307,803 B1 4/2016 Folgar
9,364,975 B2 6/2016 Preisler et al.
9,486,027 B2 11/2016 Dey et al.
9,572,390 B1 * 2/2017 Simpson ..... A42B 3/125
9,775,396 B1 * 10/2017 Olivares Velasco ..... H04B 1/3833
10,079,488 B2 9/2018 Challancin
10,165,817 B2 1/2019 Redpath et al.
10,448,695 B2 10/2019 Folgar
D900,407 S 10/2020 Hanudel et al.
10,886,646 B2 1/2021 Goupil et al.
10,928,163 B2 2/2021 Zimmer
11,353,159 B2 6/2022 Roth
11,612,207 B2 3/2023 Teetzel et al.
2003/0070200 A1 4/2003 Crye et al.
2005/0217006 A1 10/2005 Sutter et al.
2005/0255770 A1 11/2005 Crump
2006/0101556 A1 5/2006 Goldsborough
2006/0101560 A1 5/2006 Ketterer et al.
2008/0263752 A1 10/2008 Solinsky et al.
2009/0044314 A1 * 2/2009 Newman ..... A42B 3/0473 2/468
2009/0178740 A1 7/2009 Lenze et al.
2009/0222978 A1 9/2009 Fang
2009/0255036 A1 * 10/2009 Lim ..... A42B 3/10 2/181
2010/0083413 A1 4/2010 Mcgovern
2010/0229286 A1 9/2010 Ahlgren et al.
2011/0072548 A1 3/2011 Hersick et al.
2011/0094018 A1 4/2011 Rogers et al.
2011/0197327 A1 8/2011 Mcelroy et al.
2011/0203024 A1 * 8/2011 Morgan ..... F41H 1/04 2/2.5
2011/0209274 A1 * 9/2011 Del Rosario ..... A42B 3/061 2/10
2011/0277222 A1 11/2011 Garneau et al.
2012/0002046 A1 1/2012 Rapoport et al.
2012/0011631 A1 1/2012 Crossman et al.
2012/0144565 A1 6/2012 Huh
2012/0144567 A1 6/2012 Huh
2012/0167281 A1 7/2012 Gennrich et al.
2012/0174294 A1 7/2012 Sackett
2013/0000016 A1 1/2013 Hall et al.
2013/0191967 A1 8/2013 Harris
2013/0239303 A1 9/2013 Cotterman et al.
2014/0130241 A1 5/2014 Abdollahi et al.
2014/0240834 A1 8/2014 Mason
2015/0089725 A1 * 4/2015 Lowe ..... A42B 3/125 2/410
2015/0157079 A1 6/2015 Auranen et al.
2015/0223546 A1 * 8/2015 Cohen ..... A42B 3/127 2/412
2015/0246384 A1 9/2015 Ikeda et al.
2016/0075338 A1 3/2016 Henn
2016/0295948 A1 10/2016 Dowd et al.
2017/0027268 A1 2/2017 Folgar
2017/0269460 A1 9/2017 Fagerkvist
2017/0332720 A1 * 11/2017 Zimmer ..... A42B 1/245
2018/0235304 A1 8/2018 Fischer et al.
2018/0308397 A1 10/2018 Sugimoto et al.
2018/0326288 A1 * 11/2018 Simpson ..... A42B 3/128
2020/0008508 A1 1/2020 Havola
2020/0019236 A1 1/2020 Parkinson et al.
2020/0197997 A1 6/2020 Zhou et al.
2021/0037905 A1 2/2021 Ward et al.
2021/0085013 A1 * 3/2021 Czerski ..... A42B 3/063
2021/0247618 A1 8/2021 Moore et al.
2021/0315314 A1 10/2021 Teetzel et al.
2022/0071336 A1 3/2022 Franzino et al.
2023/0320452 A1 * 10/2023 Ketterer ..... A42B 3/328 2/422

FOREIGN PATENT DOCUMENTS

DE 630473 C 5/1936
DE 8138228 U1 6/1983
EP 0299168 B1 7/1995
GB 1114214 A 5/1968
WO 2016016445 A2 2/2016
WO 2018173313 A1 9/2018
WO 2020109887 A1 6/2020
WO 2020237189 A1 11/2020
WO 2022115531 A1 6/2022
WO WO-2023150548 A2 * 8/2023 ..... A42B 3/04

OTHER PUBLICATIONS

CA Office Action corresponding to Application No. 3,218,744, dated Nov. 30, 2023, 5 pages.

Dangora, Lisa .M., et al., "Deep-Drawing Forming Trials on a Cross-Ply Thermoplastic Lamina for Helmet Preform Manufacture", Journal of Manufacturing Science and Engineering, vol. 139, Mar. 2017, 8 pages.

EP Extended Search Report corresponding to Application No. 22209825.3, dated Apr. 13, 2023, 7 pages.

(56) References Cited

OTHER PUBLICATIONS

International Preliminary Report on Patentability corresponding to Application No. PCT/US2021/016807, dated Jul. 28, 2022, 8 pages.
International Preliminary Report on Patentability corresponding to Application No. PCT/US2022/028754, dated Nov. 23, 2023, 11 pages.
International Search Report and Written Opinion corresponding to Application No. PCT/IB2013/003041, dated on Feb. 9, 2015, 12 pages.
International Search Report and Written Opinion corresponding to Application No. PCT/US2021/016807, dated on Dec. 28, 2021, 11 pages.
International Search Report and Written Opinion corresponding to Application No. PCT/US2022/28754, dated Aug. 29, 2022, 12 pages.
International Search Report and Written Opinion corresponding to Application No. PCT/US2023/061745, dated Jul. 28, 2023, 15 pages.
Kriechenbauer et al., "Deep Drawing with Superimposed Low-Frequency Vibrations on Servo-Screw Presses", Procedia Engineering, vol. 81, 2014, pp. 905-913.
Lu et al., "A Novel Surface Texture Shape for Directional Friction Control" Tribology Letters, 2018, vol. 66, No. 51, 13 pages.
Patel et al., "Parametric Analysis of Deep Drawing Process for Hemisphere Dome Shape of Steel AISI 1023", Journal of Basic and Applied Engineering Research, vol. 1, No. 2, Oct. 2014, pp. 9-16.
EP Extended Search Report corresponding to Application No. 22808262.4, dated Dec. 9, 2024, 14 pages.
International Search Report and Written Opinion corresponding to Application No. PCT/US2023/077642, dated Feb. 28, 2024, 19 pages.

* cited by examiner

RECONFIGURABLE HELMET

1 CROSS-REFERENCE TO RELATED APPLICATIONS

The present application is a U.S. National Stage Application of International Application No. PCT/US2023/061745 filed Feb. 1, 2023 and published on Aug. 10, 2023 as WO2023/150548A2, which claims benefit and priority to U.S. Provisional Application No. 63/306,369 filed Feb. 3, 2022, each of which is incorporated herein by reference in its entirety for any purpose whatsoever.

2 COPYRIGHT NOTICE

A portion of the disclosure of this patent document may contain material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice shall apply to this document: Copyright @ 2021-2023 Galvion, LTD.

3 BACKGROUND

3.1 Field of the Invention

The exemplary, illustrative, technology herein relates to systems and methods for head protection devices and systems.

3.2 The Related Art

Known helmet systems include a bump or ballistic helmet shell. A user of the known helmet system can increase a level of ballistic protection provided by the helmet by attaching one or more scalable ballistic appliques to one or more outside surfaces of the helmet shell. The ballistic appliques are typically held in place by Velcro, straps, or bungees. A known helmet system typically includes active system components, for example audio, video, and situational awareness systems, which are also attached to one or more outside surfaces of the helmet shell.

A known problem is that adding one or more ballistic appliques to a known helmet system may require adjusting, or even removing, active system components and may protect only a portion of the helmet where active system components are not attached.

Another known problem is that ballistic appliques added to the outside of a known helmet leave a significant portion of the area of the user's head that is covered by the helmet unprotected by the ballistic appliques. For example, ballistic appliques applied to a known helmet system cover only approximately two thirds of the area of the user's head that is covered by the helmet, leaving one third or more of the area covered only by whatever ballistic protection may be built into the helmet.

4 SUMMARY

The inventors have recognized a need for a helmet system that allows a user to add and remove structures that provide scalable protection and other functionality to and from a helmet without requiring a user to remove or reconfigure active systems components, e.g. electronics and power devices. The inventors have created exemplary embodiments of a helmet system that solve this need. In some exemplary embodiments, a helmet is provided that includes a first portion with an outer shell. The outer shell includes mounting and connecting features that allow active systems to be mounted on the outer shell. The helmet includes a second portion disposed internally to the first portion. The second portion includes a liner. The liner is formed to receive one or more functional layer components. A user can add or remove functional layer components that provide, for example, increased ballistic protection or increased impact protection to and from the liner to increase, decrease, and/or change one or more types of protection provided to the user by the helmet. The liner portion translates relative to and is at least partially removable from the outer shell of the helmet to allow a user to access the functional layer components and to add or remove the functional layer components without removing or modifying active system components.

In a particular exemplary embodiment, the first portion includes at least an outer shell; for example, a rigid outer shell that can function as a bump shell. In some embodiments, the first portion includes one or more ballistic layers, i.e. one or more ballistic protection or ballistic-resistant layers. The helmet includes a second portion that includes a liner layer and at least one functional layer. The first portion and second portions are attached to each other. In some embodiments the first portion is translatable relative to the second portion while remaining at least partially attached to the second portion. Is some embodiments the first portion is rotatable to the second portion. In some embodiments, the second portion is removable from the first portion.

In exemplary embodiments, at least one functional layer of the second portion is a ballistic layer. One or both of the first portion or the second portion can include at least one ballistic protection layer. The one or more ballistic layers each provide protection, to a user's head, from impacts; for example, from impacts caused by ballistic projectiles striking an outer surface of a ballistic layer. A user can add a ballistic functional layer to the helmet and can remove a ballistic functional layer from the helmet. In this manner, the user can reconfigure the helmet to increase or decrease a level of ballistics protection provided by the helmet without requiring the user to remove or otherwise adjust components, including active systems components mounted to the outside of the helmet. The helmet can likewise be configured by the user to add or remove functional layers that provide one or more other types of protection; for example, one or more of blunt impact, rotational impact, and/or shock wave protection, without removing or adjusting components mounted to the outside of the helmet.

In an exemplary embodiment, the helmet includes a functional layer comprising a removable ballistic layer that covers substantially all of the surface area of a user's head that is covered by the helmet. For example, in embodiments the removable ballistic layer covers at least 70% or more of the area of the user's head that is covered by the helmet. In examples the removable ballistic layer covers 70% to 100%; for example, 80% to 96% or 96% or more of the area user's head that is covered by the helmet. In some embodiments, the helmet includes an integrated ballistic layer that covers at least the area of the user's head that is covered by the removable ballistic layer.

In a first exemplary embodiment, the helmet includes a rigid outer layer and an energy absorbing liner that together provide at least bump protection that meets requirements of BS EN 12492:2012.

In a second exemplary embodiment, the helmet further includes a first ballistic layer that is fixedly or removably attached to the rigid outer layer and the helmet provides at least protection from penetration by fragments and 9 mm rounds.

In a third exemplary embodiment, the helmet also includes a second, removable, ballistic layer in addition to the first ballistic layer. The helmet including the non-removable ballistic layer and the installed removable ballistic layer provides at least protection from penetration by 7.62 mm rounds.

A first exemplary embodiment of the helmet includes a first, outer, portion with a ballistic layer removably or permanently bonded to an inner surface of a rigid outer shell. In a second exemplary embodiment, the first portion includes the rigid outer shell without a ballistic layer.

In both exemplary embodiments, the outer shell can be formed by a molding process and one or more features, for example, one or more of ridges, fasteners, and housings, can be formed as part of the outer shell.

The first, outer, portion can be at least partially removed from a second portion of the helmet to expose one or more removable inner layers of the helmet. The second portion can be attached to the outer portion with a plurality of attachments. Suitable attachments include, but are not limited to, clips, clamps, snap baskets, snaps, pivot joints, and pins.

In one exemplary embodiment the outer portion pivots relative to the one or more removable inner layers to expose the one or more removable inner layers for removal. In some embodiments, the outer portion includes a first ballistic layer and a non-ballistic layer. The one or more inner layers may include a second ballistic layer.

The above and other features of the exemplary technology described herein including various novel details of construction and combinations of parts, and other advantages, will now be more particularly described with reference to the accompanying drawings and pointed out in the claims. It will be understood that the particular method and devices embodying the technology are shown by way of illustration and not as a limitation of the technology. The principles and features of this technology may be employed in various and numerous embodiments without departing from the scope of the technology described herein.

5 BRIEF DESCRIPTION OF THE DRAWINGS

In the accompanying drawings, reference characters refer to the same parts throughout the different views. The drawings are not necessarily to scale; emphasis has instead been placed upon illustrating the principles of the technology. The features of the present invention will best be understood from a detailed description of the invention and example embodiments thereof selected for the purposes of illustration and shown in the accompanying drawings in which.

Figure 9:
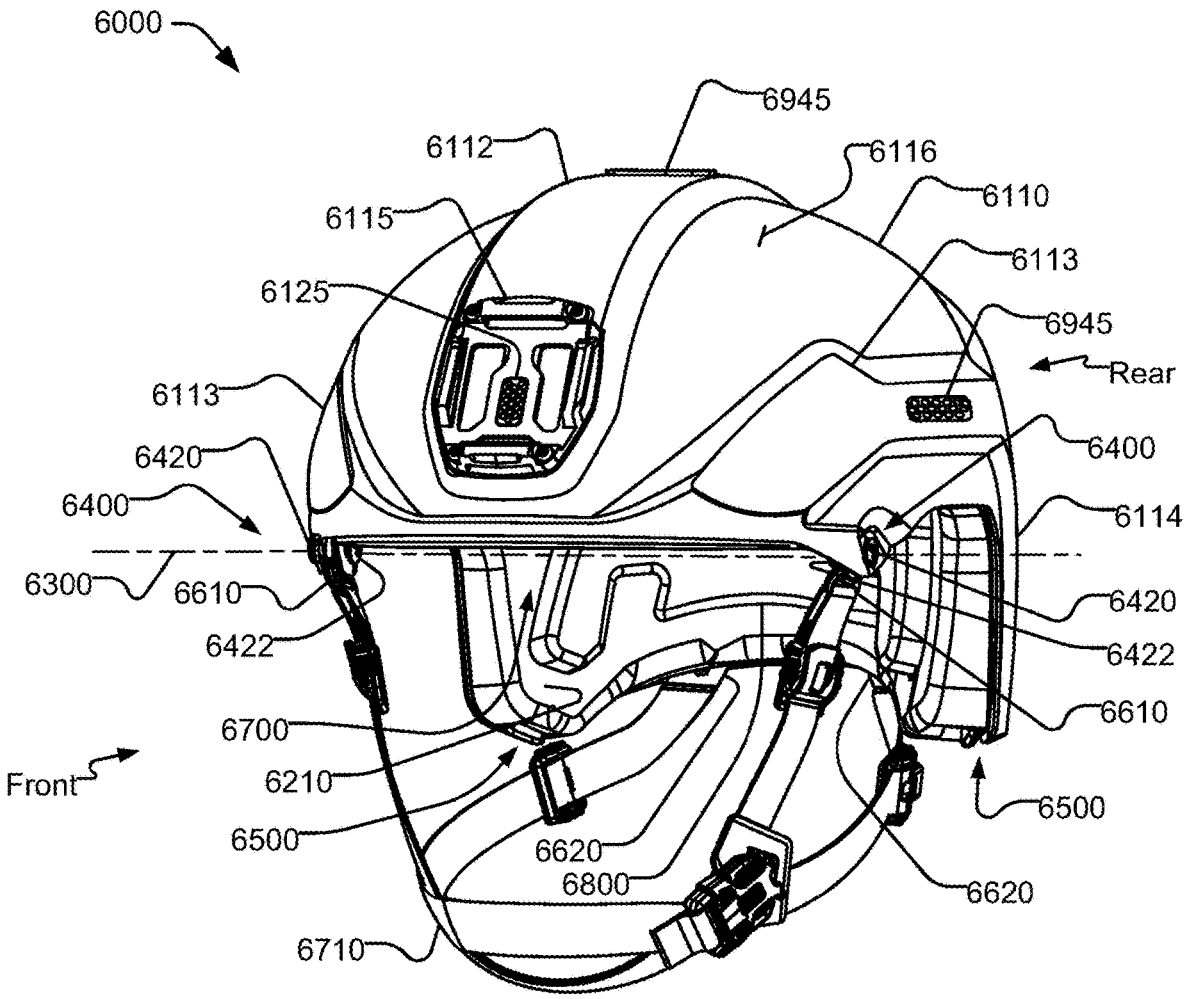
FIG. 9 depicts a front perspective view of a fourth exemplary embodiment of a helmet.
Figure 10:
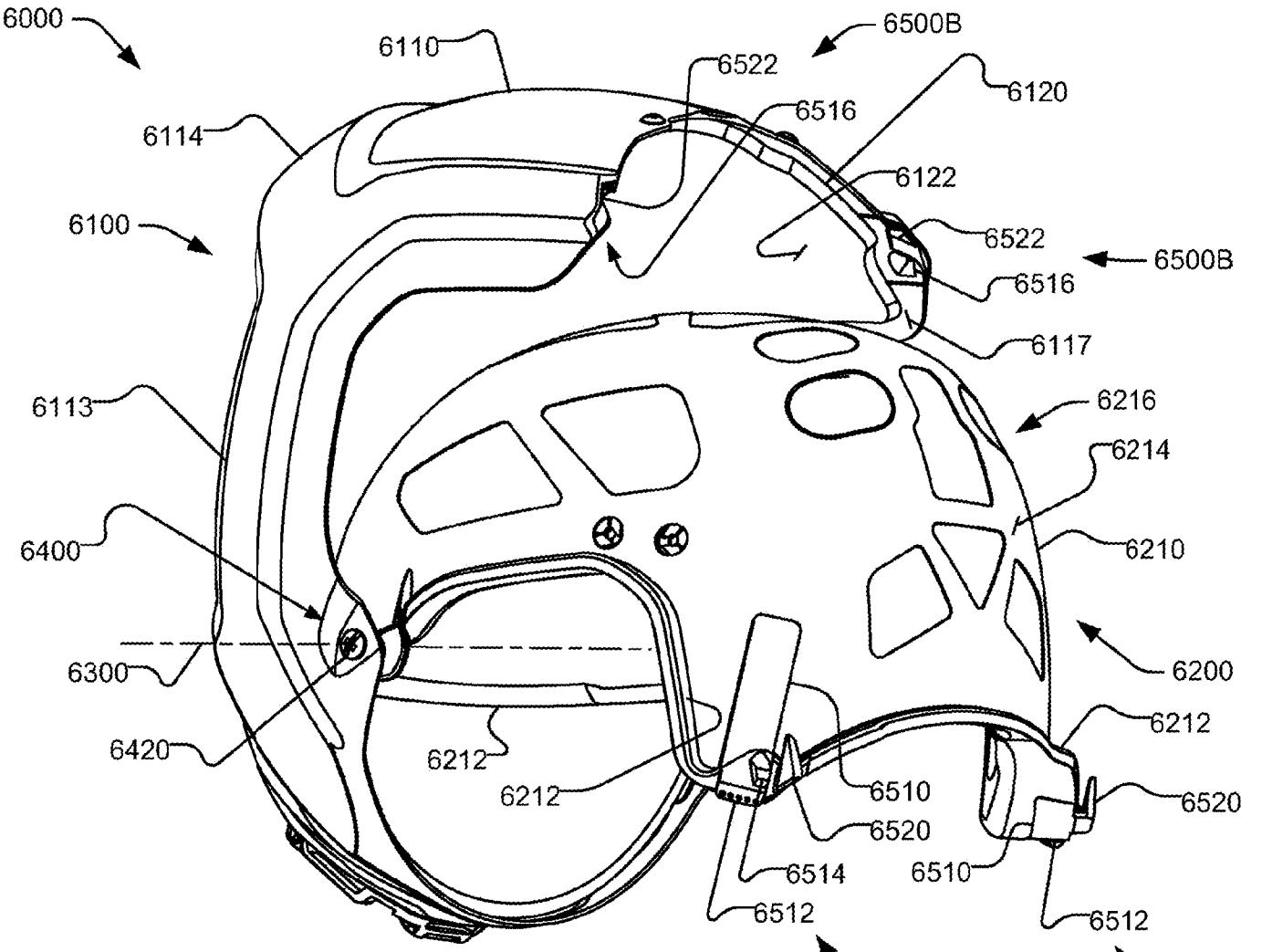

FIG. 10 a perspective view of a partially disassembled configuration of the helmet of FIG. 9.

Figure 11A:
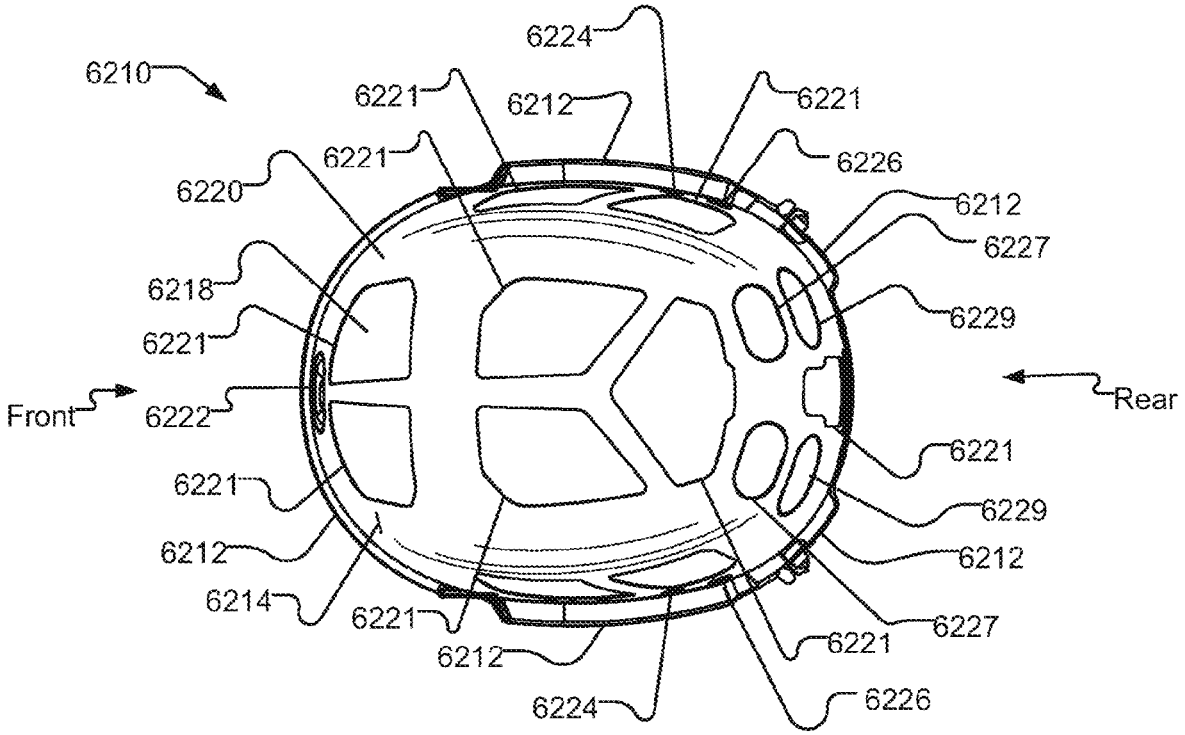

FIG. 11A depicts a top view of a liner portion of the helmet of FIG. 9.

Figure 11B:
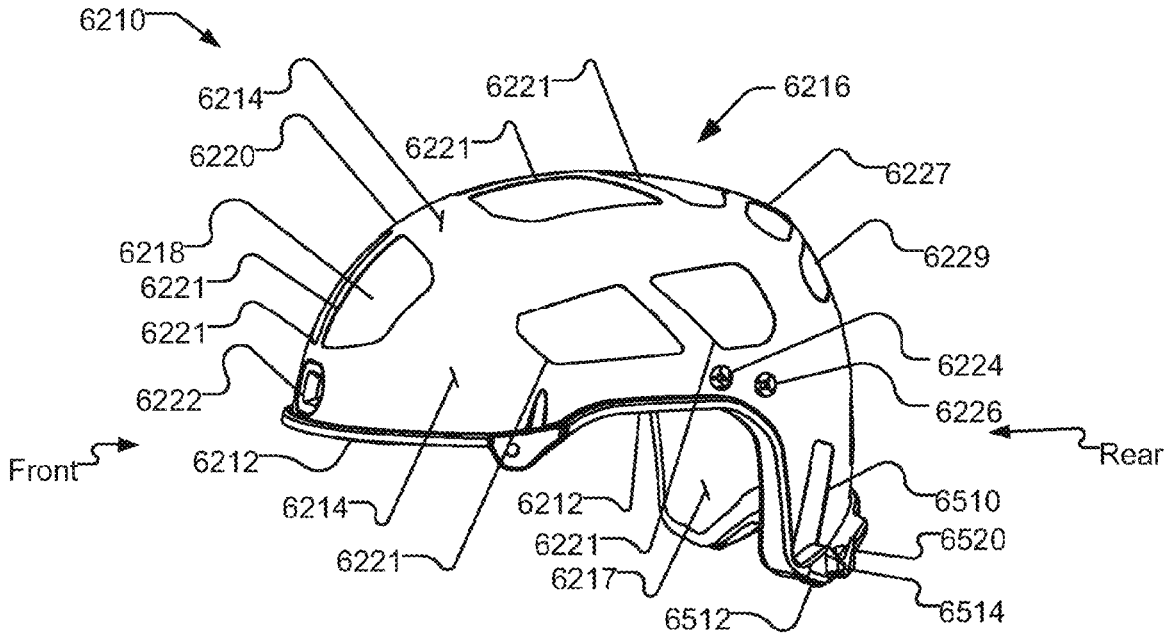

FIG. 11B depicts a perspective view of the liner portion of the helmet of FIG. 9.

Figure 12:
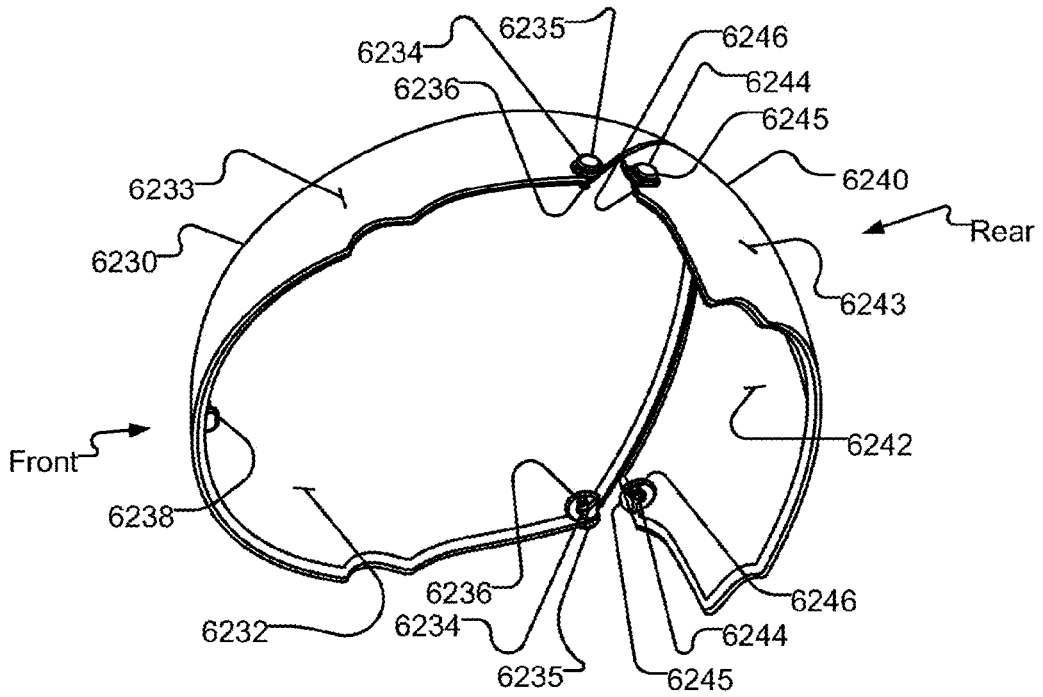

FIG. 12 depicts a bottom perspective view of a first exemplary embodiment of a front and rear functional layers of the helmet of FIG. 9.

Figure 13A:
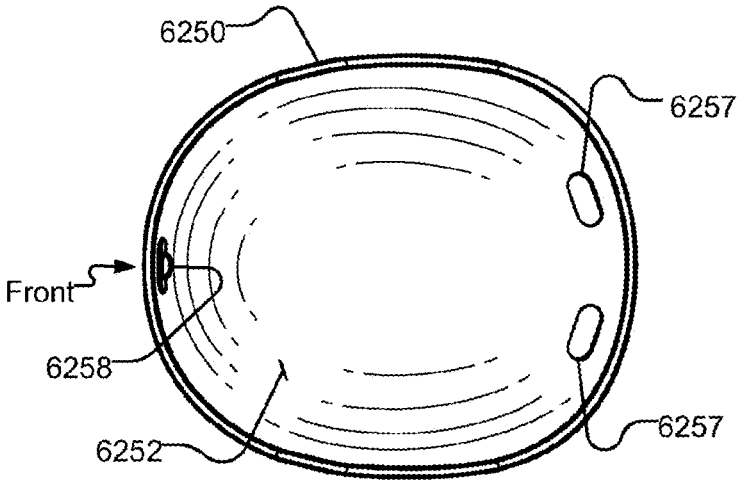

FIG. 13A depicts a bottom view of a second exemplary embodiment of a front functional layer of the helmet of FIG. 9.

Figure 13B:
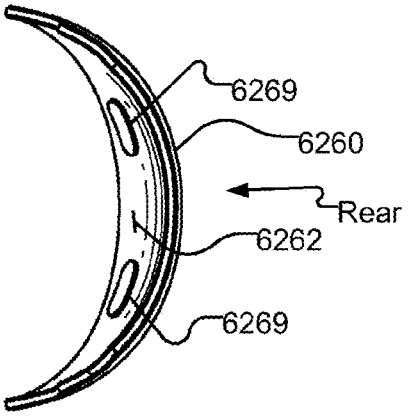

FIG. 13B depicts a bottom view of a second exemplary embodiment of a rear functional layer of the helmet of FIG. 9.

Figure 14A:
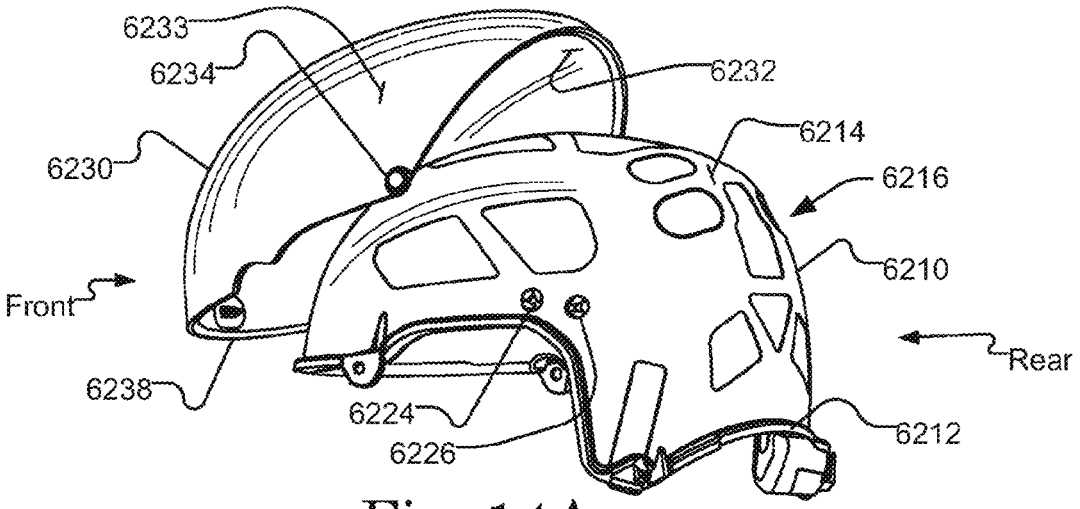

FIG. 14A depicts a side perspective of a first configuration of the liner portion of FIGS. 11A and 11B and the first embodiment of the front functional layer of FIG. 12.

Figure 14B:
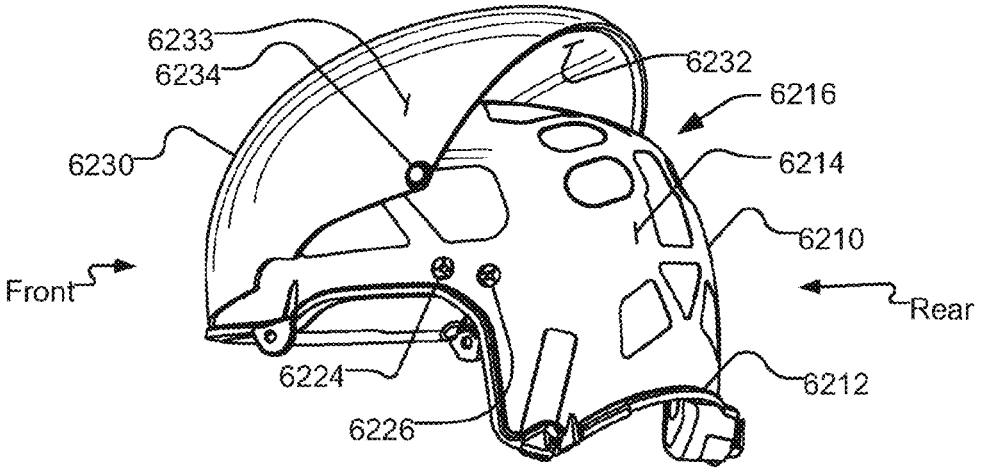

FIG. 14B depicts a side perspective of a second configuration of the liner portion of FIGS. 11A and 11B and the first embodiment of the front functional layer of FIG. 12.

Figure 14C:
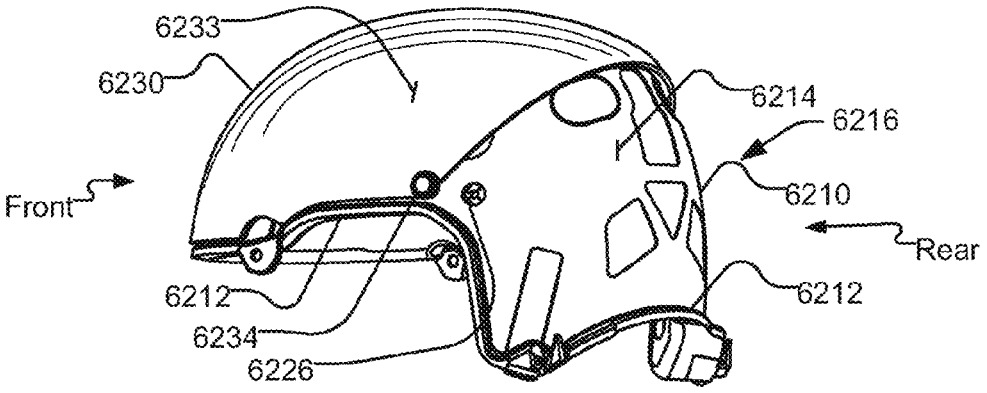

FIG. 14C depicts a side perspective of a third configuration of the liner portion of FIGS. 11A and 11B and the first embodiment of the front functional layer of FIG. 12.

Figure 15A:
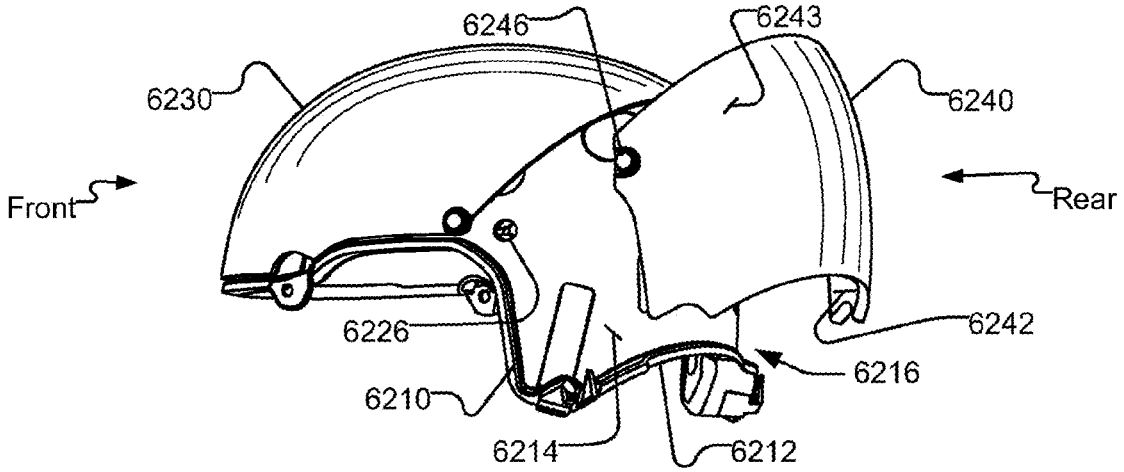

FIG. 15A depicts a side perspective of a first configuration of the liner portion of FIGS. 11A and 11B, the first embodiment of the front functional layer of FIG. 12, and the first embodiment of the rear functional layer of FIG. 12.

Figure 15B:
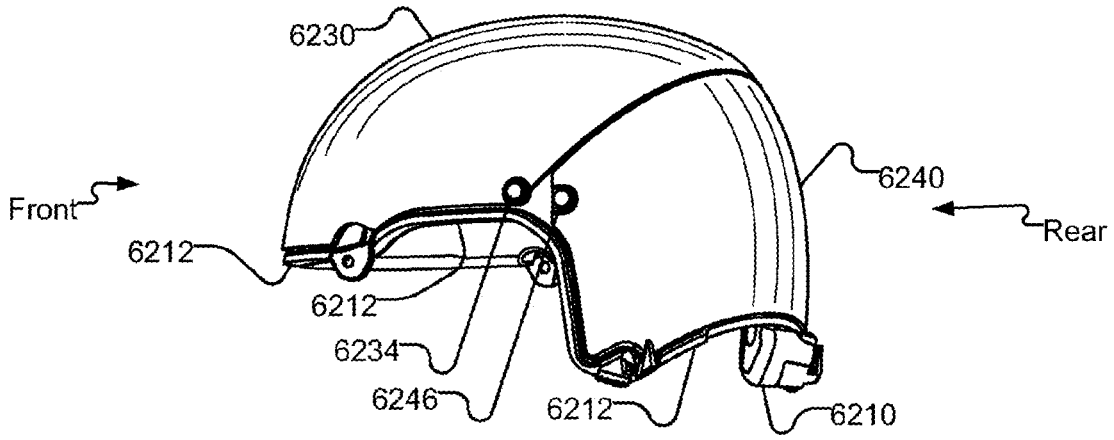

FIG. 15B depicts a side perspective of a second configuration of the liner portion of FIGS. 11A and 11B, the first embodiment of the front functional layer of FIG. 12, and the first embodiment of the rear functional layer of FIG. 12.

Figure 16:
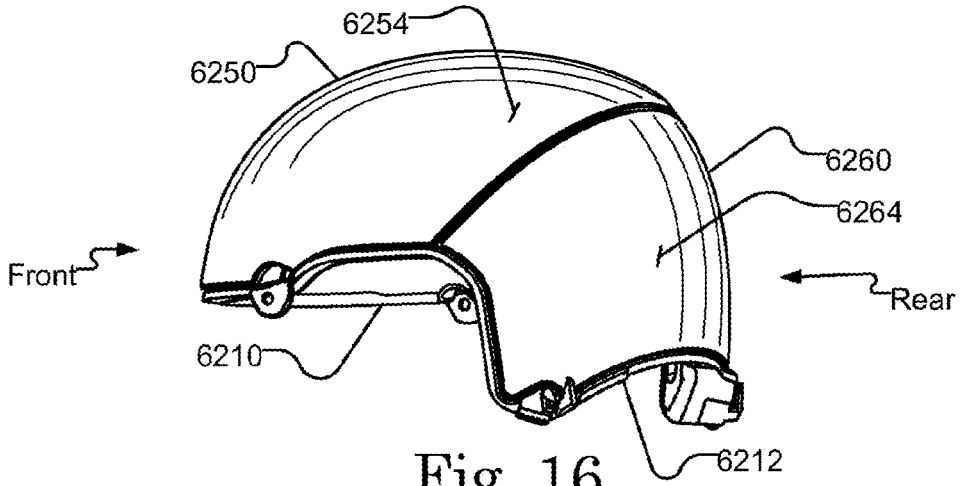

FIG. 16 depicts a side perspective of a first configuration of the liner portion of FIGS. 11A and 11B, the second exemplary embodiment of a front functional layer of FIG. 13A, and the second exemplary embodiment of a rear functional layer of FIG. 13B.

6 DETAILED DESCRIPTION

6.1 Definitions

The following definitions are used throughout, unless specifically indicated otherwise:

| TERM | DEFINITION |
|---|---|
| Ballistic layer | Ballistic layers include a first ballistic layer, ballistic ridge fill materials, and functional layers that provide ballistic protection. Ballistic layers include one or more material(s) for providing protection from penetration by projectiles; for example, bullets, shrapnel, and other fragments. A ballistic layer is ballistic-resistant; for |

-continued

| TERM | DEFINITION |
|---|---|
| | example, a layer that is resistant to penetration by ballistic bodies. Non-limiting example ballistic layers materials include ultra-high molecular weight polyethylene (UHMWPE), Aramid, and, in some embodiments, UHMWPE combined with one or more of carbon fiber and Aramid. A ballistic layer can be manufactured using a known forming process. Non-limiting example ballistic layer manufacturing methods include match metal pressing, compression molding autoclave, and filament winding, |

6.2 Item Number List

The following item numbers are used throughout, unless specifically indicated otherwise.

| # | DESCRIPTION |
|---|---|
| 1000 | Helmet |
| 1100 | First portion (outer structure) |
| 1110 | Outer shell |
| 1112 | Top ridge |
| 1113 | Side ridge |
| 1114 | Rear ridge |
| 1115 | Front mount |
| 1116 | Outer shell outer surface |
| 1117 | Outer shell inner surface |
| 1118 | Outer shell bottom edge |
| 1119 | Front helmet connector interface |
| 1120 | First ballistic layer |
| 1122 | First ballistic layer inner surface |
| 1124 | First ballistic layer outer surface |
| 1126 | First ballistic layer bottom edge |
| 1130 | Top ridge cavity |
| 1132 | Top fill layer |
| 1140 | Side ridge cavity |
| 1142 | Side ridge fill layer |
| 1150 | Rear ridge cavity |
| 1152 | Rear ridge fill layer |
| 1200 | Second portion (inner structure) |
| 1210 | Liner layer |
| 1212 | Liner lip (overlap portion) |
| 1214 | Front helmet connector recess |
| 1215 | Recess bottom surface |
| 1220 | Front functional layer |
| 1228 | Front functional layer abutting edge |
| 1230 | Rear functional layer |
| 1232 | Rear functional layer inner surface |
| 1234 | Rear functional layer outer surface |
| 1236 | Rear functional layer bottom edge |
| 1238 | Rear functional layer abutting edge |
| 1240 | Gap between functional layers |
| 1250 | Functional layer cavity |
| 1300 | Rotational axis |
| 1310 | Section line (FIG. 2A) |
| 1320 | Section line (FIG. 3) |
| 1400 | Front helmet connector |
| 1410 | Front helmet connector post |
| 1420 | Front helmet connector head |
| 1500 | Rear helmet connector |
| 1510 | Rear helmet connector liner portion |
| 1512 | Rear connector release |
| 1514 | Rear engagement portion |
| 1516 | Rear engagement portion receptacle |
| 1610 | Harness front attachment |
| 1620 | Harness rear attachment |
| 1710 | Harness |
| 1720 | Fit system |
| 1770 | Helmet interior |
| 1910 | Cable |
| 1920 | Cable |
| 1945 | Side ridge accessory attachment |
| 2000 | Helmet |

-continued

| # | DESCRIPTION |
|---|---|
| 2100 | First portion (outer structure) |
| 2110 | Outer shell |
| 2112 | Top ridge |
| 2113 | Side ridge |
| 2114 | Rear ridge |
| 2117 | Outer shell inner surface |
| 2120 | First ballistic layer |
| 2170 | Helmet interior |
| 2200 | Second portion (inner structure) |
| 2210 | Liner layer |
| 2310 | Helmet assembly axis |
| 2510 | Rear helmet connector liner portion |
| 2512 | Rear connector release |
| 2514 | Rear engagement portion |
| 2516 | Rear engagement portion receptacle |
| 2610 | Front harness attachment |
| 2620 | Rear harness attachment |
| 2810 | Front helmet connector liner portion |
| 2812 | Front helmet connector release |
| 2814 | Front engagement portion |
| 2816 | Front engagement portion receptacle |
| 3000 | Helmet (partially shown) |
| 3100 | First portion |
| 3110 | Outer shell |
| 3114 | Harness attachment |
| 3120 | First ballistic layer |
| 3200 | Second portion |
| 3210 | Liner |
| 3212 | Liner lip |
| 3220 | Functional layer |
| 3400 | Helmet connector |
| 3410 | Helmet connector post |
| 3420 | Helmet connector receptacle |
| 3700 | Harness |
| 4000 | Helmet |
| 4110 | Outer shell |
| 4112 | Top ridge |
| 4113 | Side ridge |
| 4114 | Rear ridge |
| 4117 | Descending rear ridge |
| 4116 | Outer surface of outer shell |
| 4119 | Front helmet mount |
| 4132 | Top ridge fill layer |
| 4152 | Rear ridge fill layer |
| 4154 | Rear ridge fill layer |
| 4710 | Harness |
| 4910 | Cable |
| 4920 | Cable |
| 4930 | Rear module or battery pack |
| 4945 | Side accessory attachment |
| 4950 | HUD interface device |
| 4955 | HUD attachment |
| 4965 | Rear accessory attachment |
| 5000 | Exemplary method of manufacture |
| 5100-5600 | Process steps |
| 6000 | Helmet |
| 6100 | First portion (outer structure) |
| 6110 | Outer shell |
| 6112 | Top ridge |
| 6113 | Side ridge |
| 6114 | Rear ridge |
| 6115 | Front mount |
| 6116 | Outer shell outer surface |
| 6117 | Outer shell inner surface |
| 6118 | Outer shell bottom edge |
| 6119 | Front helmet connector interface |
| 6120 | First ballistic layer |
| 6122 | First ballistic layer inner surface |
| 6200 | Second portion (inner structure) |
| 6210 | Liner |
| 6212 | Liner lip (overlap portion) |
| 6214 | Liner outer surface |
| 6216 | Functional layer cavity |
| 6217 | Liner inner surface |
| 6218 | Liner cushioning layer |
| 6220 | Liner outer shell |
| 6221 | Liner outer shell openings |

-continued

| # | DESCRIPTION |
|---|---|
| 6222 | Front functional layer tab receptacle |
| 6224 | Front functional layer snap basket |
| 6226 | Rear functional layer snap basket |
| 6227 | Front attachment pad |
| 6229 | Rear attachment pad |
| 6230 | Snap attached front functional layer |
| 6232 | Snap attached front functional layer inner surface |
| 6233 | Snap attached front functional layer outer surface |
| 6234 | Front functional layer snap |
| 6235 | Front functional layer snap head |
| 6236 | Front functional layer snap post |
| 6238 | Front functional layer tab |
| 6240 | Snap attached rear functional layer |
| 6242 | Snap attached rear functional layer inner surface |
| 6243 | Snap attached rear functional layer outer surface |
| 6244 | Rear functional layer snap |
| 6245 | Rear functional layer snap head |
| 6246 | Rear functional layer snap post |
| 6250 | Pad attached front functional layer |
| 6252 | Pad attached front functional layer inner surface |
| 6254 | Pad attached front functional layer outer surface |
| 6257 | Front functional layer attachment pad |
| 6258 | Front functional layer tab |
| 6260 | Pad attached rear functional layer |
| 6262 | Pad attached rear functional layer inner surface |
| 6264 | Pad attached rear functional layer outer surface |
| 6269 | Rear functional layer attachment pad |
| 6300 | Rotational axis |
| 6400 | Front helmet connector |
| 6420 | Outer front helmet connector head |
| 6422 | Inner front helmet connector head |
| 6500 | Rear helmet connector |
| 6500A | Rear helmet connector liner portion |
| 6500B | Rear helmet connector helmet portion |
| 6510 | Rear helmet connector liner portion |
| 6512 | Rear connector release |
| 6514 | Rear engagement portion |
| 6516 | Rear engagement portion receptacle |
| 6520 | Rear alignment portion |
| 6522 | Rear alignment portion receptacle |
| 6610 | Harness front attachment |
| 6620 | Harness rear attachment |
| 6710 | Harness |
| 6770 | Helmet interior |
| 6800 | Comfort pad |
| 6945 | Ridge accessory attachment |

6.3 Detailed Description of the Invention

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms of the articles "a", "an", and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence of addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
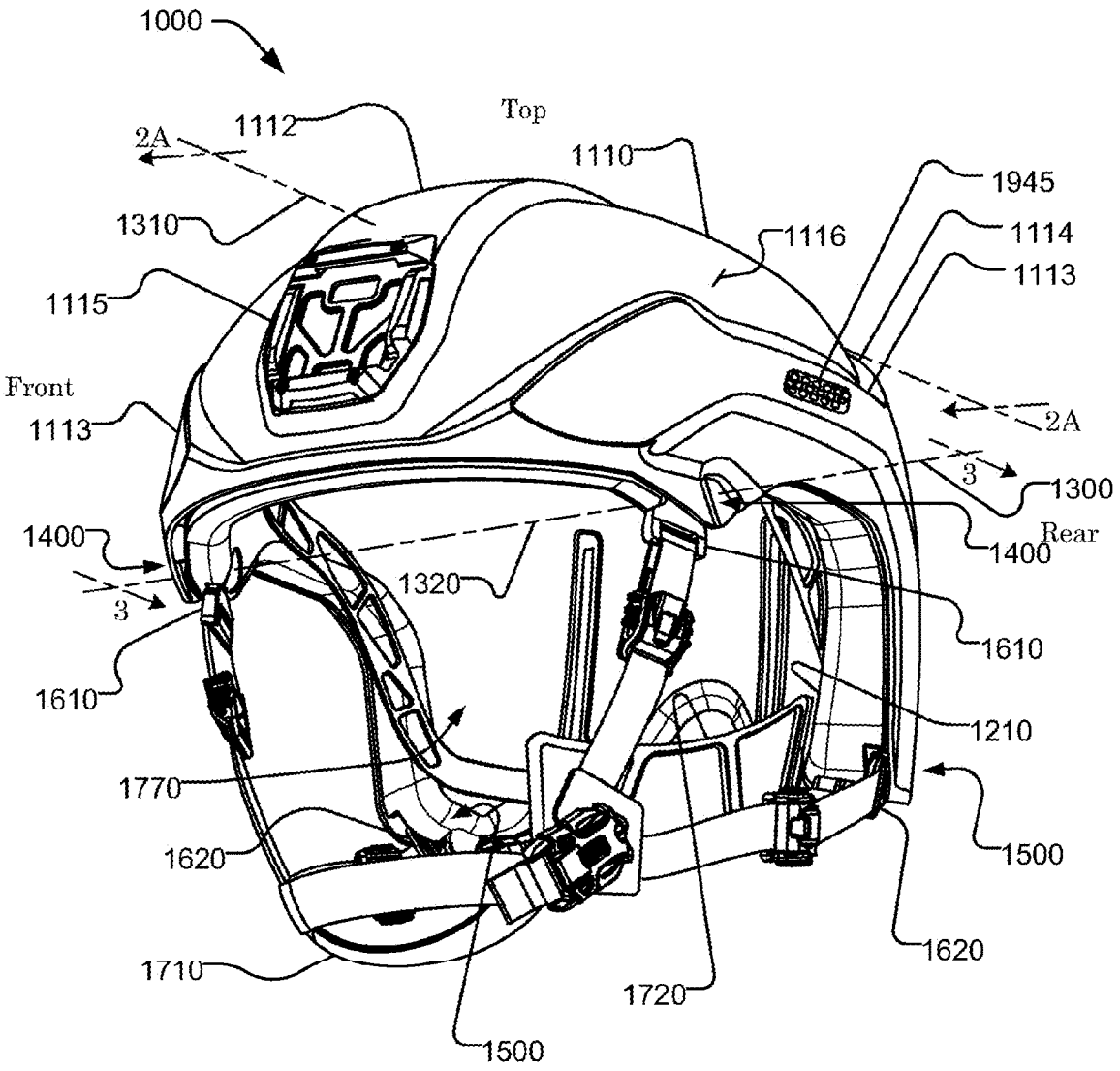
FIG. 1 depicts a perspective view of a first exemplary embodiment of a helmet.

Referring now to FIG. 1, a helmet 1000 is shown. The helmet 1000 includes an outer shell 1110 including a top ridge 1112, two side ridges 1113, a rear ridge 1114, and a front mount 1115. The helmet includes a liner 1210, a harness 1710, and a fit system 1720. The helmet includes two harness front attachments 1610, two harness rear attachments 1620, two front helmet connectors 1400, and two rear helmet connectors 1500. A rotational axis 1300 passes through each of the two front helmet connectors 1400. The two front helmet connectors 1400 are aligned along the rotational axis 1300.

The outer shell 1110 is formed from one or more rigid materials. In some embodiments, the outer shell 1110 is formed from one or more rigid composite materials. Some non-limiting examples of composite materials useful for forming the outer shell include carbon fiber, fiberglass, and Kevlar or Aramid. Some exemplary, non-limiting methods useful for forming an outer shell comprising one or more composite materials include hand layup, vacuum bagging, autoclave, and resin transfer molding (RTM), although any suitable known composite material forming process may be used. An exemplary additional or alternative embodiment of an outer shell may be formed from one or more plastic materials. Some exemplary, non-limiting methods useful for forming an outer shell comprising one or more plastics include injection molding, thermoforming, injection-blow molding, extrusion blow-molding, and roto-molding.

Advantageously, the outer shell 1110 can be formed separately from other components of the helmet 1000. Forming the outer shell separately allows molded-in or formed features to be created on the outer shell, unlike known helmets wherein a rigid outer shell is formed contemporaneously with other components such as one or more layers of ballistic protection material. Molded-in or formed features include the top ridge 1112, the rear ridge 1114, and each of the side ridges 1113, which are formed as protrusions from the outer shell 1100. The ridges provide extra rigidity to the outer shell 1110 which can increase its resistance to blunt impacts.

Additional molded-in features include an accessory attachment feature for attaching the front mount 1115 to the helmet 1000 and a side ridge accessory attachment 1945. One or more active system components (not shown) can be attached to the front mount 1115. Example active system components that can be attached to the front mount 1115 include, but are not limited to, a night vision viewing device and an augmented reality display visor. Side ridge accessory attachment 1945 can include mechanical features for attaching one or more active system accessories (not shown) to the helmet 1000 as well as one or more receptacles for mounting electronic connectors to interface with the one or more active system accessories. Non-limiting examples of active system components that can be attached to accessory attachment 1945 include strobes, headsets, cameras, illumination systems, identification friend or foe (IFF) systems, and laser detection systems. In embodiments, additional or alternative molded-in features can be formed in the outer shell including, for example, additional accessory attachment features for mechanical and electronic connectors and for electronic components on one or more of the ridges 1112, 1113, and 1114.

The top ridge 1112 extends along a top surface of the outer shell and extends generally from a front portion of the outer shell to a rear portion of the outer shell. One side ridge 1113 is disposed on each of a left and a right side of the outer shell. The side ridges 1113 each extend from a front portion of the outer shell towards a rear portion of the outer shell. The rear ridge 1114 extends from left to right across a rear portion of the outer shell. Each of the top ridge 1112, side ridges 1113, and rear ridge 1114 define a hollow cavity conforming to the shape of the ridge beneath an outer surface 1116 of outer shell 1110.

The liner 1210 is disposed in helmet interior 1770. In a non-limiting exemplary embodiment the liner 1210 is formed from a cushioning material, for example from one or more expanded foam materials, e.g., one or more of expanded polypropylene (EPP) or expanded polystyrene (EPS), formed, for example, using an injection molding or expansion process. In some exemplary embodiments, the liner includes one or more materials having a lattice or honeycomb structure, for example a lattice or honeycomb structure that is designed to deform under impact to absorb or dissipate pressure, formed for example using a 3D printing process or other manufacturing process. An exemplary honeycomb structure includes a welded tube material similar to that marketed by Koroyd, Le Triton, 5 Rue du Gabian, 98000 Monaco. An exemplary carbon-based lattice structure is manufactured by Carbon, Inc. An exemplary, non-limiting liner can include one or more active polymers that are configured to absorb and dissipate pressure, for example, one or more active polymers or a helmet liner system comprising one or more active polymers provided by D30, 7-8 Commerce Way, London, GB and/or Rheon, 26F Congress St, Suite 167, Saratoga Springs, NY.

The liner 1210 can further include one or more comfort pads (not shown), for example one or more comfort pads that may be permanently or removably attached to an inner surface of the liner. Exemplary, non-limiting embodiments of comfort pads include combinations of foams and textiles and can include one or more gels, visco-elastic materials, and active polymers. In non-limiting exemplary embodiments, comfort pads are manufactured using one or more of die-cutting, stitching, compression forming, and ultrasonic welding.

The front helmet connectors 1400 and rear helmet connectors 1500 attach the liner 1210 to the outer shell 1110. Although the present exemplary embodiment of a helmet 1000 includes two front helmet connectors 1400 and two rear helmet connectors 1500, embodiments of helmets that include more or fewer helmet connectors are anticipated by the technology described herein. Additional exemplary embodiments can include, for example, one front helmet connector, one rear helmet connector, three or more front helmet connectors, and/or three or more rear helmet connectors; for example, four or six rear helmet connectors. In some embodiments, the liner 1210 functions as a suspension system. The fit system 1720 is attached to the liner 1210. The fit system includes one or more adjustable components, for example a known fit dial system, for modifying the fit on the user's head. The fit system 1720 may be attached to and removed from the helmet 1000 independently of the harness 1710. It is noted that a helmet 1000 can be configured without a fit system 1720 without deviating from the technology described herein.

The two harness front attachments 1610 and two harness rear attachments 1620 are each attached to the outer shell 1110. In a non-limiting example, the harness front and rear attachments are attached to the outer shell by a threaded connector that is screwed into mating threads formed in the outer shell. The harness 1710 is attached to the outer shell via the front and rear harness attachments. The harness 1710 holds the helmet 1000 on a user's head. Because the harness 1710 is attached, via the harness attachments 1610, 1620, to the outer shell 1110, it also aids in holding the liner 1210 in place when the helmet 1000 is worn by a user. The harness 1710 can be attached to and removed from the helmet 1000 independently of the fit system 1720. Although the present exemplary embodiment of a helmet 1000 includes two harness front attachments 1610 and two harness rear attachments 1620, embodiments of helmets that include more or fewer harness attachments are anticipated by the technology described herein. In some embodiments, the harness 1710 and fit system 1720 comprise helmet and fit systems disclosed in U.S. patent application Ser. No. 15/284,121, "Helmet Assembly," filed Oct. 3, 2016, the entire disclosure of which, except for any claims, definitions, disclaimers, disavowals, and inconsistencies, is incorporated herein by reference.

Figure 2A:
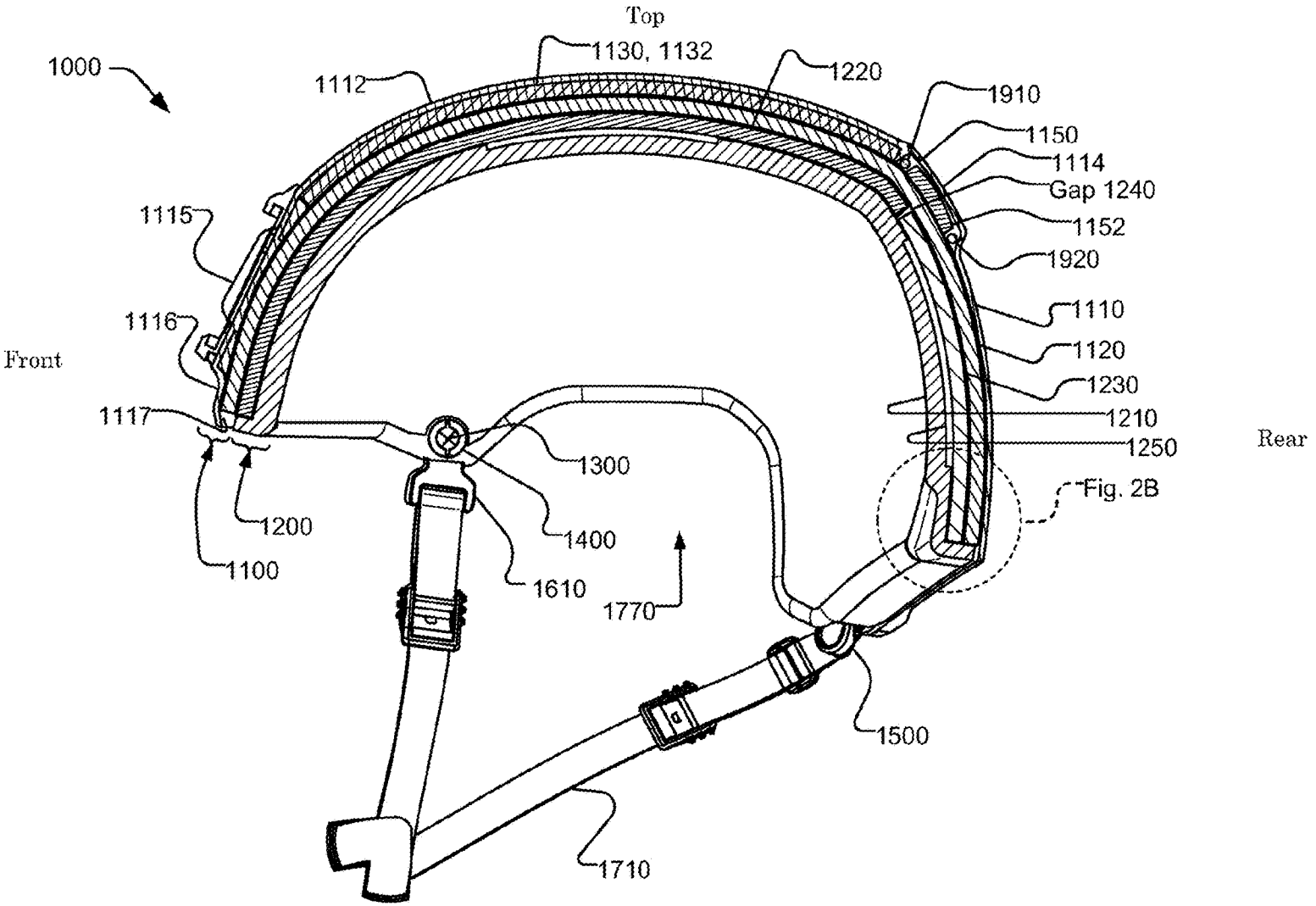
FIG. 2A depicts a side cross sectional view of the helmet of FIG. 1, taken along line 2A-2A of FIG. 1.
Figure 2B:
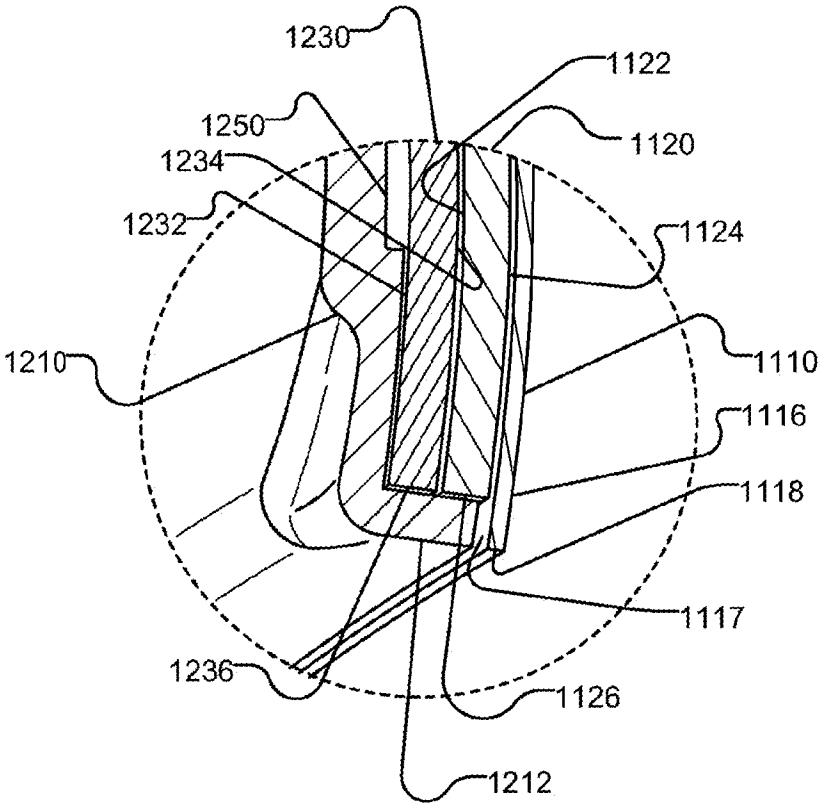
FIG. 2B depicts a detail view of the side cross sectional view of the helmet of FIG. 1, taken within the circle labeled 2B in FIG. 2A.
Figure 3:
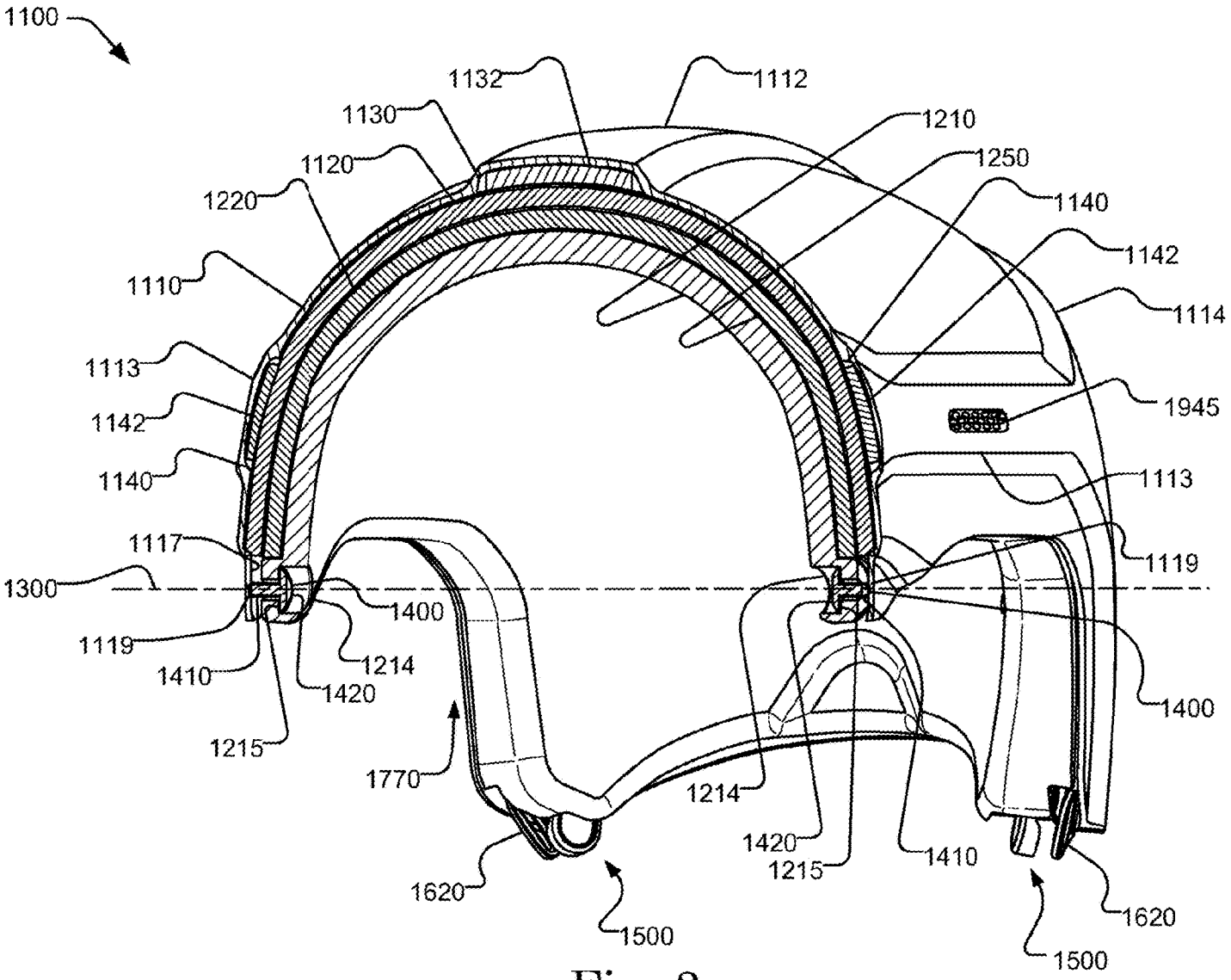
FIG. 3 depicts a front cross-sectional view of the helmet of FIG. 1, taken along line 3-3 of FIG. 1.

Referring now to FIGS. 2A, 2B, and 3, the helmet 1000 of FIG. 1 is shown in multiple cross-sectional views. Specifically, FIG. 2A depicts a cross-sectional view of the helmet 1000 through line 2A-2A shown in FIG. 1 and FIG. 3 depicts a cross-sectional view of the helmet 1000 through line 3-3 shown in FIG. 1. Additionally, FIG. 2B is an enlargement illustrating the details of the area depicted in the dashed circle labelled 2B in FIG. 2A. Also, for clarity, the fit system 1720 is omitted and the harness 1710 is only shown in FIG. 2A. However, it is understood that the helmet 1000 includes the harness 1710 and can optionally include a fit system, as depicted in FIG. 1.

The helmet 1000 includes a first portion 1100, a second portion 1200, and a helmet interior 1770. The first portion 1100 includes the outer shell 1110 and a first ballistic layer 1120. The first ballistic layer 1120 includes an inner surface 1122, an outer surface 1124, and a bottom edge 1126. The outer shell 1110 includes the top ridge 1112, a top ridge cavity 1130, the rear ridge 1114, a rear ridge cavity 1150, the side ridge 1113, and a side ridge cavity 1140, and side ridge accessory attachment 1945. The outer shell 1110 includes an inner surface 1117, the outer surface 1116 and a bottom edge 1118 disposed between the inner surface 1117 and the outer surface 1116. The outer shell includes front helmet connector interfaces 1119. The first portion 1100 includes a top ridge fill layer 1132, a side ridge fill layer 1142, a rear ridge fill layer 1152, and cables 1910 and 1920. The helmet 1000 includes two harness front attachments 1610, two harness rear attachments 1620, and the harness 1710.

The helmet includes a second portion 1200 which includes the liner layer 1210, a front functional layer 1220, and a rear functional layer 1230. The liner layer 1210 includes two front helmet connector recesses 1214, a liner lip 1212, and a functional layer cavity 1250. The rear functional layer includes an inner surface 1232, an outer surface 1234, and a bottom edge 1236 disposed between the inner surface 1232 and the outer surface 1234.

The helmet includes two front helmet connectors 1400 and two rear helmet connectors 1500. The front helmet connectors 1400 each includes a front helmet connector post 1410 and a front helmet connector head 1420.

The first ballistic layer 1120 is formed from one or more layers of ballistic resistant material as defined herein. The first ballistic layer 1120 can be formed as a non-rigid structure. In some embodiments, the first ballistic layer 1120 includes one or more layers that include carbon fiber and/or Aramid fibers, which can increase a stiffness of the first ballistic layer. The first ballistic layer may be formed using any suitable process; for example, by pressing and shaping a stack of ballistic material layers using a known forming process. The first ballistic layer 1120 is attached to the outer shell 1110. In some exemplary embodiments, the first ballistic layer is permanently bonded to the outer shell, for example with a layer of adhesive disposed between the inner surface 1117 of the outer shell and the outer surface 1124 of the first ballistic layer. In other exemplary embodiments, the first ballistic layer 1120 is removably attached to the outer shell 1110; for example, by disposing a bead of adhesive between the first ballistic layer and the outer shell along a bottom edge 1126 of the first ballistic layer. The bead of adhesive may later be removed or cut to allow the first ballistic layer to be removed from the outer shell. In alternative embodiments (not shown) the first portion 1100 does not include the first ballistic layer 1120.

As previously disclosed, the outer shell 1110 is formed with multiple ridges including top ridge 1112, side ridges 1113, and rear ridge 1114. The structure of the ridges adds mechanical stiffness to the outer shell. The ridges form ridge cavities between the outer shell 1110 and the first ballistic layer 1120. One or more ridge fill materials may be disposed in each of the ridge cavities to further increase the stiffness and strength of the outer shell and/or to add ballistic protection to the outer shell. The cavities are also useful as conduits for cables; for example, one or more of communication and power cables.

As best seen in FIGS. 2A and 3, the top ridge 1112 includes the top ridge cavity 1130 and top ridge fill layer 1132 disposed in the top ridge cavity. Referring to FIG. 3, each side ridge 1113 includes a side ridge cavity 1140 with a side ridge fill layer 1142 disposed in the side ridge cavity. Returning to FIG. 2A, rear ridge 1114 includes the rear ridge cavity 1150 and the rear ridge fill layer 1152 disposed within the rear ridge cavity. Each fill layer 1132, 1142, and 1152 can comprise one or more of a stiffening fill material and a ballistic layer, as previously defined. Exemplary, non-limiting stiffening fill materials include one or more of a stiff foam matrix, a structural foam (e.g. Core cell), a honeycomb structure, for example as supplied by Koroyd, and fully encapsulated corrugated cardboard. In an exemplary embodiment, top ridge fill layer 1132 comprises a stiffening fill material and rear ridge fill layer 1152 includes a ballistic protection material.

As shown in FIG. 2A, cables 1910 and 1920 are disposed in the rear ridge cavity 1150, adjacent to the rear ridge fill layer 1152. Although not shown, the cables 1910 and 1920, and in some embodiments one or more additional cables, may be disposed in one or more of the top ridge cavity 1130 and one or both of the side ridge cavities 1140. The ridge cavities thus advantageously function as conduits for communication and power cabling which may be run through the ridge cavities between electronic interfaces and active system components attached to the helmet.

The liner 1210 includes a functional layer cavity 1250. The front functional layer 1220 and rear functional layer 1230 are each removably disposed in the functional layer cavity, between the liner and the first portion 1100 and in particular between the liner and the first ballistic layer 1120. A user can add one or more functional layers to the functional layer cavity, remove one or more functional layers, and exchange a second functional layer for a first functional layer. In this manner, the functional layers are configurable and reconfigurable by a user.

Although two functional layers 1220 and 1230 are illustrated, the helmet 1000 can include more or fewer functional layer components without deviating from concepts of the disclosed technology. For example, the helmet can include a single functional layer, or three or more functional layers, for example 3, 4, 5, or 6 functional layers, each of which can be disposed between the liner 1210 and the first portion 1100. In an alternative embodiment that does not include a first ballistic layer (not shown), the functional layers 1220 and 1230 are disposed between the liner 1210 and the outer shell 1110.

A functional layer, e.g. 1220 and/or 1230, can be formed with known structures and materials suitable for performing described functions of the layer. Exemplary functional layer types and functions are listed in Table 1, below.

TABLE 1

Functional Layer Types

| Functional layer type | Description of exemplary functions and embodiment(s) |
|---|---|
| Ballistic protection | Functional layer comprising a ballistic layer as defined herein. |
| Blunt impact protection | Functional layer including a material formed to absorb and/or attenuate pressure waves caused by a blunt impact received by a helmet. Exemplary, non-limiting blunt impact protection functional layers are formed from one or more cushioning materials, for example from one or more of: expanded foam materials, e.g., one or more of expanded polypropylene (EPP) or expanded polystyrene (EPS), formed, for example, using an injection molding or expansion process; a honeycomb structure, e.g. made from plastic, metal (for example aluminum) that may be designed to deform under impact to absorb or dissipate pressure, formed for example using a 3D printing process or other manufacturing process; exemplary honeycomb structure includes a welded tube material similar to that marketed by Koroyd, Monaco; a lattice structure, for example a 3D lattice structure that may deform elastically or plastically to absorb pressure, e.g. a carbon-based lattice structure manufactured by Carbon, Inc., Redwood City CA; one or more active polymers that are configured to absorb and dissipate pressure, for example one or more active polymers provided by D3O, Saratoga Springs, NY. Other embodiments can include textiles, for example 3D knitted textiles, including, e.g. a textile that includes opposing layers of textile material with filaments disposed between the layers; and example textile is FEAM (Fiber Energy Absorbing Material) manufactured by Corsair Innovations, Plymouth, MA. |
| Rotational impact protection | Functional layer including a material formed to absorb and/or attenuate pressure waves caused by a rotational impact received by a helmet. Exemplary, non-limiting rotational impact protection functional layers are formed from materials and using manufacturing processes as described previously in relation to blunt impact protection functional layers. Other embodiments may include combinations of foams and textiles and can include one or more gels, visco-elastic materials, and active polymers. |
| Shock wave mitigation | Functional layer including a material formed to absorb and/or attenuate shock waves caused, for example, by an explosion or impact. Exemplary, non-limiting shock wave mitigation functional layers include one or more gel and/or composite viscoelastic materials, for example one or more shear thickening materials. |
| Ventilation | Functional layer that includes a structure with open air passageways that allow air to flow through the structure. Exemplary structures include soft or rigid honeycomb structures or open cell foam structures. Exemplary, non-limiting structures useful for venting include honeycomb structured such as those provided by Koroyd and lattice structures such as those provided by Carbon, Inc., as described previously in relation to liner 1210. Ventilation can also be enabled by an empty space formed within the structure of a helmet when a functional layer is absent. Active venting can be provided, for example, by a fan blowing air through one or more channels comprising a functional layer. |

TABLE 1-continued

| Functional Layer Types | |
|---|---|
| Functional layer type | Description of exemplary functions and embodiment(s) |
| Power or energy storage | Functional layer that includes a structure or device configured to store electrical energy. An exemplary device includes one or more flat battery cells, for example a flat, flexible pouch battery or a rigid conformal battery formed in the shape of a functional layer, e.g. 1220 or 1230. |
| Heating | Functional layer that includes a structure that includes a heat generating device or material, for example an electric resistance heater or a chemical heater. Heating may also be provided by blowing warmed air through channels formed in a functional layer. |
| Cooling | Functional layer that includes a cooling device or material, for example an electronic chiller or a chilled material, for example a chilled phase change material. |
| Sensor | An example sensor functional layer includes one or more sensors, e.g. one or more of a temperature sensor, moisture sensor, torque sensor, or orientation sensor, mounted on or in a carrier material. In some exemplary embodiments, the carrier material can comprise a second type of structural layer, for example an impact protection layer can include a pressure sensor. |
| Antenna | An exemplary antenna functional layer includes one or more electrically conducting elements formed as an antenna array, which may be mounted on a carrier material. In some embodiments, the carrier material can comprise a second type of structural layer. |

In a further exemplary embodiment, one or both of the functional layers 1220 and 1230 may be removed from the helmet 1000, leaving the functional layer cavity 1250 empty, thereby providing an air space between the liner 1210 and the first ballistic layer 1120. The air space has multiple useful properties; for example as a conduit for the circulation and venting of hot or cold air and as a gap for decoupling the first portion 1100 of the helmet 1000 from the liner layer 1210, thereby preventing or dampening the transmission of shock waves and impact-induced pressure waves through the structure of the helmet 1000 to a user's head.

Returning now to FIG. 3, each front helmet connector 1400 includes a front helmet connector post 1410 and a front helmet connector head 1420 attached to the front helmet connector post. The front helmet connector post 1410 is formed as a round cylinder, although other cylindrical cross-sectional shapes, for example a multi-sided polygonal shape, can be used as long as rotation of a mating component around the post is not prevented. The front helmet connector head 1420 is formed as a flat disc with a flat side and a convex side opposing the convex side. A first end of the front helmet connector post 1410 is attached to the round flat side of the front helmet connector head 1420 and an opposing second end of the front helmet connector post is attached to the outer shell 1110. Each front helmet connector post 1410 has a post longitudinal axis aligned parallel to the length of the front helmet connector post and each post longitudinal axis is aligned with the rotational axis 1300. In embodiments, the outer shell 1110 includes front helmet connector interfaces 1119 for attaching the front helmet connector posts 1410 to the outer shell. An example front helmet connector interface 1119 includes a threaded receptacle or boss comprising a threaded receptacle for interfacing with corresponding threads on a front helmet connector post. In alternative embodiments, not shown, a front helmet connector interface can include one or more connectors or posts bonded to the inner surface 1117 of the outer shell 1110.

The liner 1210 includes two front helmet connector recesses 1214, which are formed as cylindrical indentations extending from a surface of the liner facing the helmet interior 1770 toward the first portion 1100 and up to a recess bottom surface 1215 disposed partway through a thickness of the liner. Each front helmet connector 1400 is disposed within a front helmet connector recess 1214 with the flat surface of the front helmet connector head 1420 opposing, but not attached to, the bottom surface 1215 of the front helmet connector recess. An interface between each front helmet connector head 1420 and each front helmet connector recess 1214 attaches the liner 1210 to the outer shell 1110 while allowing the liner to rotate relative to the outer shell around the front helmet connector posts 1410 and rotational axis 1300. The rear helmet connectors 1500 releasable connect the liner 1120 to the outer shell 1110 so that a rear portion of the liner can translate relative to the first portion 1100.

Returning now to FIGS. 2A and 2B, the liner 1210 includes a lip 1212 which extends over a bottom edge of the functional layers 1220 and 1230; for example, over bottom edge 1236 of rear functional layer 1230. At least a portion of the liner lip 1212 extends over a bottom edge 1126 of the first ballistic layer 1120. A front portion of the liner lip 1212 extends over the front functional layer 1220 but not over a front portion of the first ballistic layer 1120 to allow the liner layer 1210 to rotate relative to the first portion white a rear portion of the liner lip extends over the bottom edge 1126 of the first ballistic layer 1120 and over the bottom edge 1236 of the rear functional layer 1230. Advantageously, the liner lip 1212 covers and protects the bottom edges, e.g. 1236 and 1126, from damage. Accordingly, the bottom edges do not require protection by an edge sealing structure, as in known helmet designs. This eliminates the need to perform edge sealing manufacturing steps for the helmet 1100.

Figure 4:
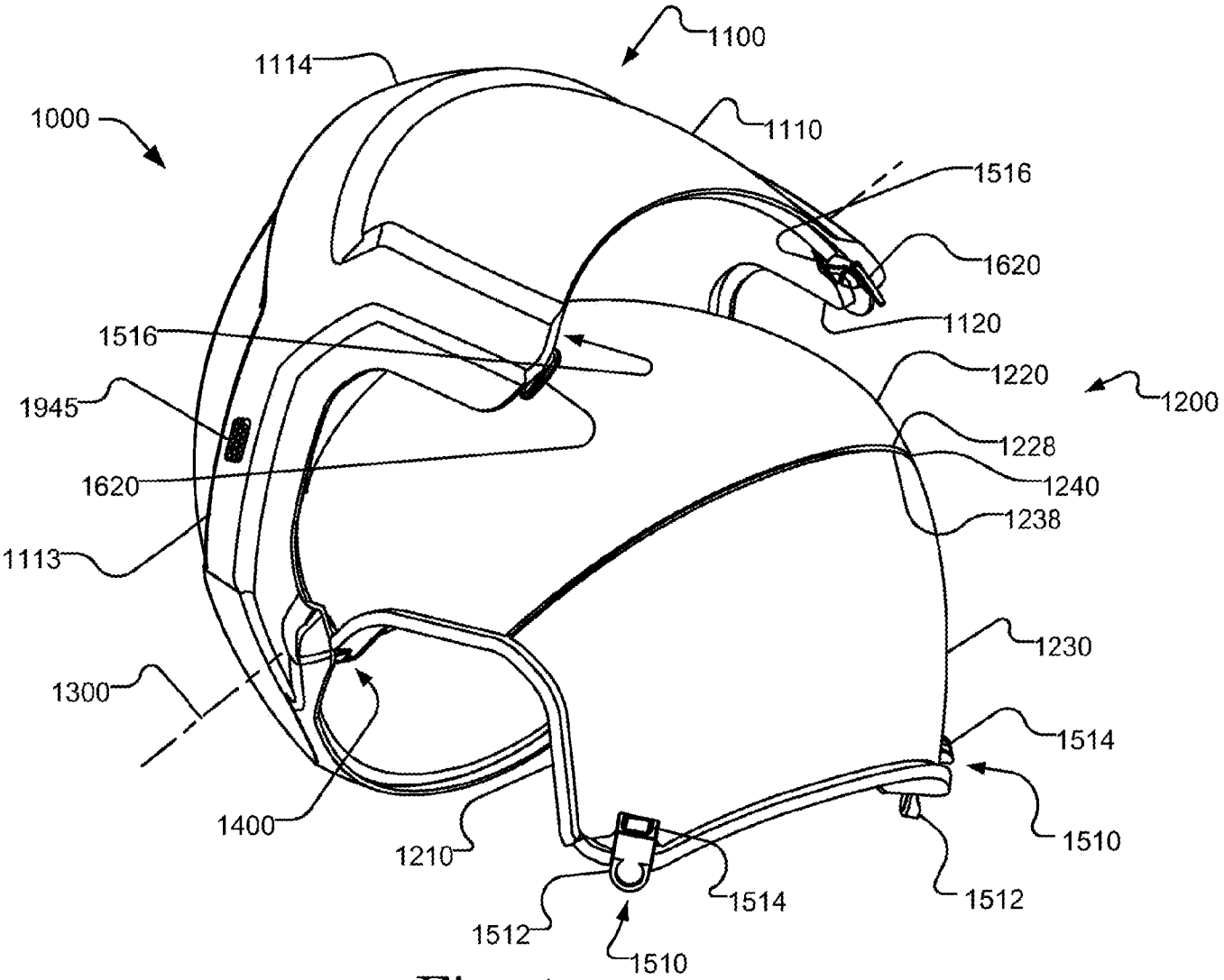
FIG. 4 depicts a perspective view of a partially disassembled configuration of the helmet of FIG. 1.

Referring now to FIG. 4, the helmet 1000 is shown in an open configuration wherein the second portion 1200, including liner 1210, has been rotated relative to the first portion 1100 to expose functional layers 1220 and 1230 for removal and/or replacement. The helmet 1000 includes components described in relation to FIGS. 1 through 3 wherein like components are labeled with like numbers.

The functional layers 1220 and 1230 are positioned close to or abutting each other such that there is at least a seam between the functional layers where they meet. In some implementations there may be a small gap between the functional layers. For example, the front functional layer 1220 has an edge 1228 which is adjacent to an edge 1238 of the rear functional layer 1230. A gap 1240 is disposed between the front functional layer edge 1228 and the rear functional layer edge 1238. Referring once again to FIG. 2A, when the helmet 1000 is closed, the rear ridge 1114 and rear ridge fill layer 1152 are disposed over the gap 1240. In an embodiment, the rear ridge fill layer 1152 is made from a ballistic protection material and provides ballistic protection for the gap 1240. In this manner, when each of the first functional layer 1220 and second functional layer 1230 includes a ballistic material, the rear ridge fill layer provides continuity in ballistic protection over the gap 1240.

Referring to FIGS. 1 through 3 and to FIG. 4, each rear helmet connector 1500 includes a rear helmet connector liner portion 1510 which is attached to liner 1210. Each rear helmet connector liner portion 1510 includes a rear connector release 1512 and rear engagement portion 1514. Each rear helmet connector 1500 includes a rear engagement portion receptacle 1516, formed on the outer shell 1100. In some embodiments, an engagement portion receptacle 1516 includes a cavity in the outer shell for engaging with a corresponding rear engagement portion 1514. In other embodiments, the rear engagement portion receptacle 1516 includes a boss structure protruding from the inner surface 1117 of the outer shell 1110. The boss structure may be formed with the outer shell or may be bonded to the outer shell in a subsequent manufacturing step.

Each rear helmet rear engagement portion 1514 interfaces with a corresponding rear engagement portion receptacle 1516 to hold the helmet in a closed position, as illustrated in FIGS. 1 through 3. A user can at least partially disengage the first portion 1100 from the second portion 1200 to expose the functional layers 1220 and 1230 without using tools. To do so, the user can push on a rear connector release 1512 to cause the rear helmet connector liner portion 1510 to flex and thereby disengage the rear engagement portion 1514 from the rear engagement portion receptacle 1516. When the user disengages the two rear engagement portions 1514 from the two rear engagement portion receptacles 1516, the first portion 1100 and second portion 1200 can be rotated relative to each other around front helmet connectors 1400 and rotational axis 1300, to expose the front functional layer 1220 and rear functional layer 1230. A user then can remove one or more functional layers, replace one or more functional layers, and add one or more functional layers when the helmet 1000 is open, as illustrated in FIG. 4. The user can close the helmet by rotating the first portion relative to the second portion 1200 until the rear helmet engagement portions 1514 engage with corresponding engagement portion receptacles 1516.

Figure 5:
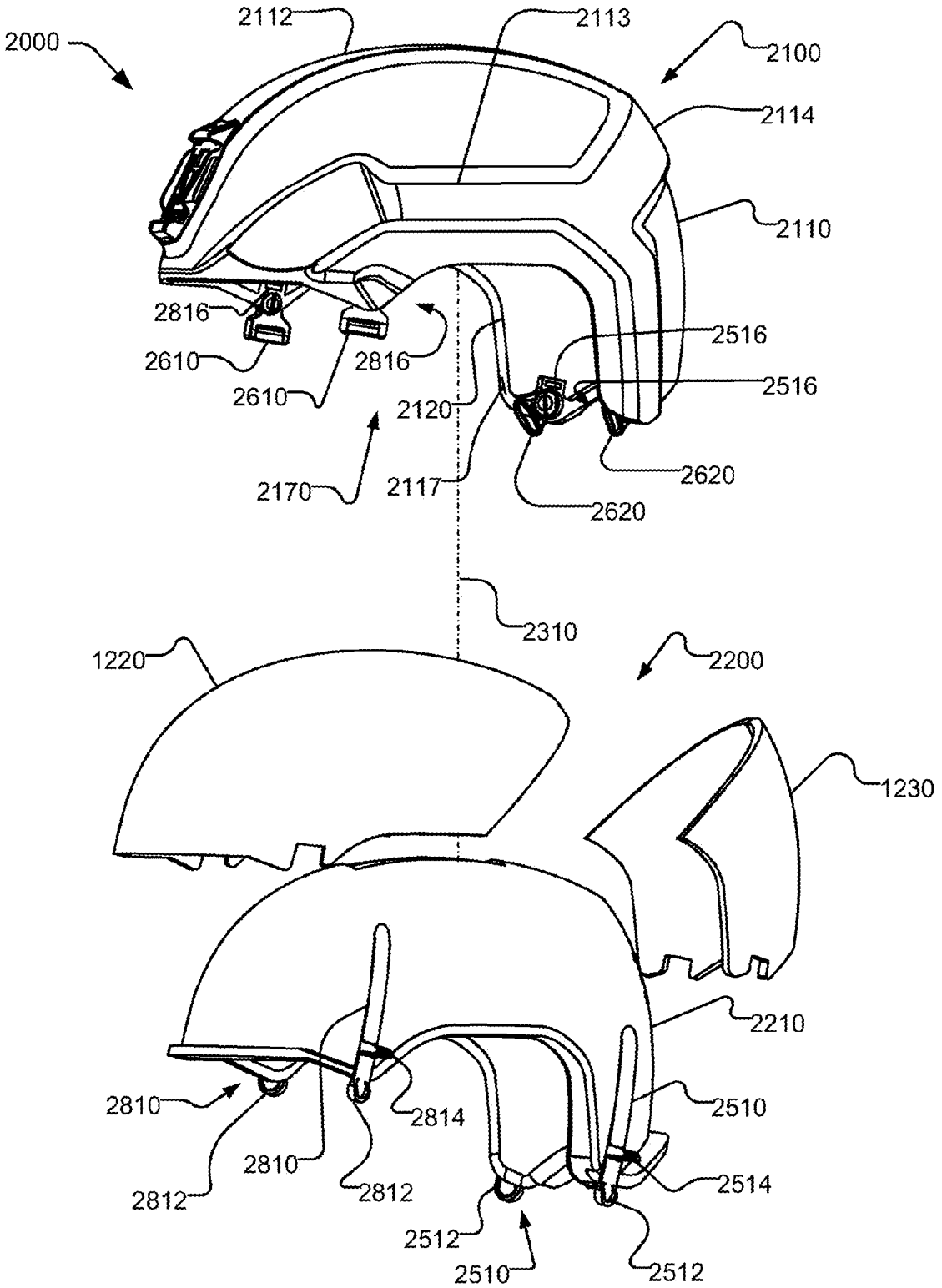
FIG. 5 depicts an exploded view of a second exemplary embodiment of a helmet.

Referring now to FIG. 5, a second embodiment of a helmet 2000 is shown in an alternative open configuration wherein a second portion 2200 of the helmet, including liner 2210, has been removed from the first portion 2100 to expose functional layers 1220 and 1230 for removal and/or replacement.

The first portion 2100 includes an outer shell 2110 and a first ballistics layer 2120 which are each similar in form, manufacture, and function to the outer shell 1110 and to the first ballistic layer 1120, described previously in relation to helmet 1000 and depicted FIGS. 1 through 4. The first portion includes a helmet interior 2170. The outer shell 2110 includes top ridge 2112, side ridge 2113, rear ridge 2114, front harness attachments 2610, and rear harness attachments 2620 each of which are similar in form, manufacture, and function to corresponding ridge features 1112, 1113, 1114, and harness attachments 1610 and 1620 described in relation to helmet 1000 and depicted in FIGS. 1 through 4. Helmet 2000 includes a harness (not shown) connected to harness attachments 2610 and 2620. The harness is omitted from FIG. 5 for clarity. Although the present exemplary embodiment of a helmet 2000 includes two harness front attachments 2610 and two harness rear attachments, 2620 embodiments of helmets that include more or fewer harness attachments are anticipated by the technology described herein.

The helmet 2000 includes a second portion 2200 which includes a liner layer 2210, front functional layer 1220, and rear functional layer 1230. The front and rear functional layers 1220 and 1230 have been described previously. The liner 2210 is similar in form, manufacture, and function to liner layer 1220 described in relation to helmet 1000 and depicted in FIGS. 1 through 4. In some embodiments, a fit system (not shown) and one or more comfort pads (not shown) may be attached to an inner surface of liner 2210.

The second portion includes two rear helmet connector liner portions 2510 and two front helmet connector liner portions 2810. Each rear helmet connector liner portion 2510 includes a rear connector release 2512 and rear engagement portion 2514. Each front helmet connector liner portion 2810 includes a front connector release 2812 and front engagement portion 2814. The first portion 2100 of the helmet 2000 includes two rear engagement portion receptacles 2516 and two front engagement portion receptacles 2816. The rear and front engagement portion receptacles 2516, 2816 are each formed on the outer shell 2100. In some embodiments, an engagement portion receptacle 2516 or 2816 includes a cavity in the outer shell for engaging with a corresponding helmet engagement portion 2514 or 2814. In other embodiments, the engagement portion receptacle 2516 or 2816 includes a boss structure protruding from the inner surface 2117 of the outer shell 2110. The boss structure may be formed with the outer shell or may be bonded to the outer shell in a subsequent manufacturing step. Although the present exemplary embodiment of a helmet 2000 includes two front helmet connector liner portions 2810 and two rear helmet connector liner portions 2510, embodiments of helmets that include more or fewer helmet connector liner portions, and corresponding engagement portion receptacles 2516, 2816, are anticipated by the technology described herein. Additional exemplary embodiments can include, for example, one front helmet connector liner portion, one rear helmet connector liner portion, three or more front helmet connector liner portions, and/or three or more rear helmet connector liner portions, with a corresponding number of engagement portion receptacles.

Helmet 2000 differs from helmet 1000 at least in the manner in which functional layers 1220 and 1230 can be exposed for removal and/or replacement. The second portion 2200, including liner layer 2210 and functional layers 1220 and 1230, can be completely removed from the first portion 2100.

When helmet 2000 is closed, each rear engagement portion 2514 interfaces with a corresponding rear engagement portion receptacle 2516 and each front helmet engagement portion 2814 interfaces with a corresponding front helmet engagement receptacle 2816 to hold the second portion 2200 within the helmet interior 2170 in contact with first portion 2100.

To open helmet 2000, as shown in FIG. 5, a user can push on front connector releases 2812 and rear connector releases 2512 to disengage the front engagement portions 2814 from the front engagement portion receptacles 2816 and to disengage the rear engagement portions 2514 from the rear engagement portion receptacles 2615. When the front and rear engagement portions 2814, 2514 are disengaged, the user can separate the first portion 2100 front the second portions 2200 of the helmet 2000, thereby exposing the front functional layer 1220 and rear functional layer 1230. A user can remove one or more functional layers, replace one of more functional layers, and add one or more functional layers when the helmet 2000 is open, as illustrated in FIG. 5. The user can close the helmet 2000 by fitting the first portion 2100 and second portion 2200 together, for example by pushing the first portion onto the second portion along helmet assembly axis 2310 until the front engagement portions 2814 interface with the front engagement portion receptacles 2816 and the rear engagement portions 2514 interface with the rear engagement portion receptacles 2516.

Referring to FIGS. 4 and 5, specific configurations of releasable fasteners have been described, i.e. rear helmet connector liner portions 1510 and 2510, rear engagement portion receptacles 1516 and 2516, front helmet connector liner portions 2810, and front engagement portion receptacles 2816. However, the inventive concepts described herein are not limited to the described fasteners. Any suitable fastener can be used to releasably attach a first portion 1100 or 2100 to a second portion 1200 or 2200 of a helmet 1000 or 2000. Some non-limiting example connectors that may be used include one or more of a sliding lock connector, snap fit connector, or rotation lock connector. In a particular embodiment, a sliding lock connector mounted on the outer shell 1110 or 2110 includes a pointed or barbed engagement portion that interfaces with a corresponding receptacle on the liner 1210 or 2210.

Figure 6B:
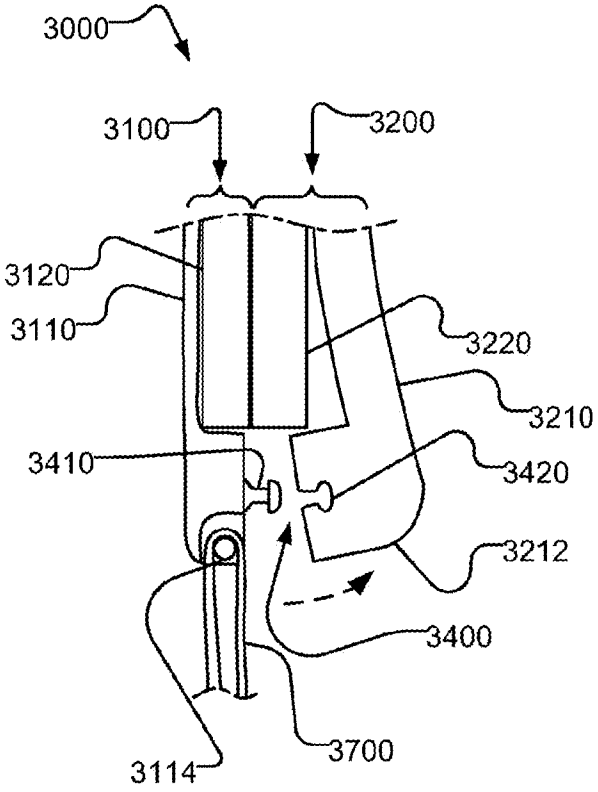
FIG. 6B depicts a cross sectional view of a portion of the helmet of FIG. 6A, illustrating the helmet connector in a detached configuration.
Figure 6A:
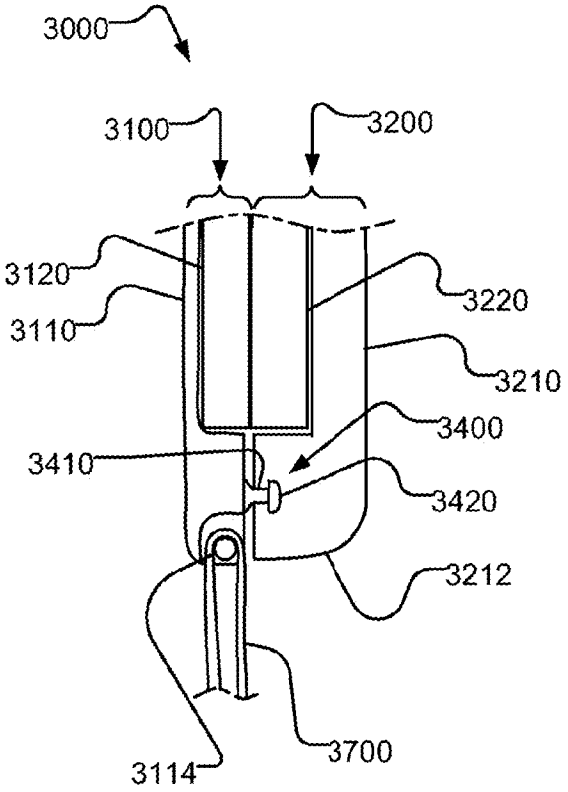
FIG. 6A depicts a cross sectional view of a portion of an exemplary embodiment of a helmet, illustrating a helmet connector in an attached configuration.

Referring to FIGS. 6A and 6B, an additional, non-limiting embodiment of a releasable helmet connector 3400 is shown. The helmet connector 3400 can be used as a front helmet connector or as a rear helmet connector. The helmet connector 3400 includes a helmet connector post 3410 and a helmet connector receptacle 3420. A partial section view of helmet 3000 includes a first portion 3100 that includes an outer shell 3110 and a first ballistic layer 3120 and a second portion 3200 that includes a liner 3210 and a functional layer 3220. The outer shell 3110 includes a harness attachment 3114 and a helmet connector post 3410. The liner 3210 includes a liner lip 3212 and a helmet connector receptacle 3420. A harness 3700 is attached to the outer shell 3110 via the harness attachment 3114.

The liner 3210 is shown removably attached to the outer shell 3110 in FIG. 6A and detached from the outer shell in FIG. 6B. The liner 3210 is attached to the outer shell by interfacing the helmet connector receptacle 3420 with the helmet connector post 3410. In embodiments, helmet connector receptacle 3420 includes one or more snap baskets which may be assembled onto or over molded in the liner 3210. The helmet connector post 3410 includes a head that is releasably captured within the helmet connector receptacle 3420. In some embodiments, the helmet connector includes a linear array of two or more connector posts 3410 and a corresponding linear array of helmet connector receptacles 3420. A user can disengage helmet connector 3400, and one or more additional helmet connectors, from helmet 3000 to expose the functional layer 3220, remove or replace the functional layer, and reengage the helmet connector 3400 to hold the functional layer in place with the liner 3120. In an embodiment, a helmet 3000 includes multiple helmet connectors 3400; for example, two helmet connectors arranged on opposite sides of a front portion of the helmet and two helmet connectors arranged on opposite sides of a rear portion of the helmet. A user can disengage one or more helmet connectors 3400 while leaving one or more, for example two, helmet connectors engaged. The user can then rotate the first portion 3100 and second portion 3200 relative to each other around the one or more engaged helmet connectors to expose one or more functional layers 3220.

Referring once again to FIG. 4 and to FIG. 5, at least partially detaching a first portion of a helmet from a second portion of a helmet, for example partially detaching the first portion 1100 from the second portion 1200 and completely detaching the first portion 2100 from the second portion 2200, to enable adding, removing, and changing functional layers has multiple advantages. One advantage is that the functional layers can be accessed, for example to add a ballistic protection functional layer, without tools and without altering any active system components that are mounted on the outer shell 1110 or 2110. Referring to FIG. 4, a particular advantage of the disclosed method of rotating the first portion 1100 relative to the second portion 1200 is that the first portion 1100 and the second portion 1200 remain connected to each other.

Figure 7:
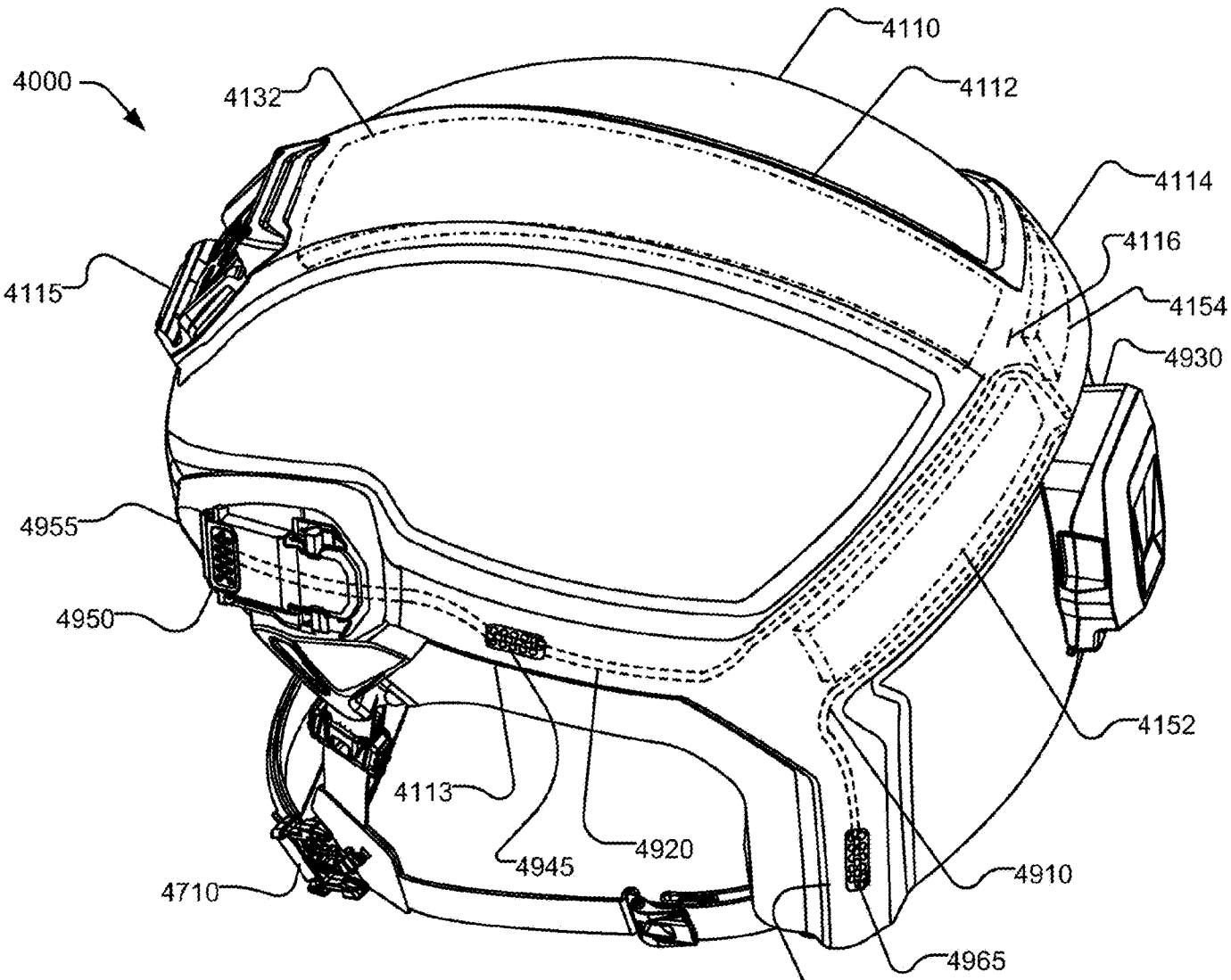
FIG. 7 depicts a perspective view of a third exemplary embodiment of a helmet.

Referring to FIG. 7, a helmet 4000 is shown that includes cabling routed through ridges interconnecting electronic devices and accessory interfaces. The helmet 4000 includes an outer shell 4110. The outer shell includes molded-in or formed features including a top ridge 4112, a side ridge 4113, a rear ridge 4114, and a descending rear ridge 4117. The outer shell includes a front accessory mount 4115, a side ridge accessory attachment 4945, a rear accessory attachment 4965, and a HUD accessory attachment 4955. The helmet 4000 includes a HUD interface 4950 and rear module and/or battery pack 4930. The helmet includes a top ridge fill layer 4132 and two rear ridge fill layers 4152 and 4154 as well as cables 4910 and 4920.

The helmet 4000 includes one or more additional layers (not shown) disposed below outer shell 4110. Although additional portions, layers, and components are not shown in FIG. 7, in embodiments the helmet 4000 is configured, referring to FIGS. 1 through 5, in a similar manner to helmets 1000 and 2000. Referring once again to FIG. 7, the outer shell 4110 and ridges 4112, 4113, 4114, and 4117 are similar to, referring to FIGS. 1 through 5, the outer shells and ridges previously disclosed in relation to the helmets 1000 and 2000. Referring once again to FIG. 7, each ridge 4112, 4113, 4114, and 4117 defines a cavity that, in some embodiments, is enclosed by the outer shell 4110 and a first ballistic layer (not shown) or by a component of a second portion of the helmet (not shown).

Components illustrated in dashed and dash-dot lines are disposed beneath the outer shell 4110, in one or more cavities formed by the ridges 4112, 4113, 4114, and 4117 interior to the outer surface 4116 of the outer shell. The top ridge fill layer 4132 is disposed under the top ridge 4112 and the rear ridge fill layers 4152 and 4154 are disposed beneath the rear ridge 4114. Cable 4910 is disposed under the rear ridge 4114 and the descending rear ridge 4117. Cable 4920 is disposed under rear ridge 4114 and descending rear ridge 4117.

One or more communication and/or power cables, e.g. cables 4910 and 4920, can be routed through one or more ridges, for example through ridges 4113, 4114, and 4117. The cables can be routed through ridges that also contain ridge fill material. Referring now to FIG. 2A, cables 1910 and 1920 are routed through the rear ridge cavity 1150 between the rear ridge 1114 and the first ballistic layer 1120, alongside rear ridge fill layer 1152. Referring once again to FIG. 7, cables 4910 and 4920 are routed under the rear ridge 4114, next to the rear ridge fill layer 4152. One or more cables also can be routed through a ridge that does not include a ridge fill layer; for example the cable 4920 is routed through the side ridge 4113.

Cables can be routed through ridges to interconnect various electronic components comprising or connected to the helmet 4000, accessory attachments, and active system components attached to the helmet and connected to the accessory attachments. The cables 4910 and 4920 provide electronic and communication connections. In other embodiments, cables can provide one or the other of electronic and communication connections. The cable 4910 connects the rear module 4930 to the rear accessory attachment 4965. The cable 4920 connects the rear module 4930 to the side accessory attachment 4945 and to the HUD interface device 4950.

The rear module 4930 can include one or more of a processor and associated memory, a communication router, and a power supply device. The rear module can provide power to one or more active system devices and can route communications between active system devices and one or more devices or systems located remotely from the helmet. In some embodiments, the rear module includes one or more program modules for processing data received from or provided to one or more active system components.

The accessory attachments 4945 and 4965 each include mechanical and electronic connectors for attaching, powering, and communicating with active system devices attached to the helmet 4000 at one or more accessory attachments. Heads up display (HUD) attachment 4955 is a special purpose accessory attachment for attaching the HUD interface device 4950 to the helmet 4000. A connector portion of an HUD can be interfaced with the HUD interface device 4950 to provide power and data communication connections to the HUD. One or more additional or alternative active system components can be interfaced with other accessory attachments, e.g. with the side accessory attachment 4945 and with the rear accessory attachment 4965. Non-limiting examples of active system components that can be attached to an accessory attachment include strobes, headsets, cameras, illumination systems, identification friend or foe (IFF) systems, and laser detection systems.

The cables and electronic connections on the helmet 1000 and the helmet 4000 are reconfigurable. A user can remove and replace one or more of cables 4910 and 4920, accessory attachments 4945 and 4965, HUD interface device 4950, and rear module 4930. The user also can add additional cabling and additional accessory attachments. The user can access the cavities under the ridges to add, remove, and replace cables and accessory attachments. For example, referring once again to FIGS. 2A and 4, a user can at least partially remove the first portion 1100 of the helmet 1000 from the second portion 1200, thereby exposing the first ballistic layer 1120. The user can then partially or completely remove the first ballistic layer 1120, for example by cutting through a bead of adhesive holding an edge of the first ballistic layer in contact with the outer shell 1110, to expose the cables 1910 and 1920. Referring once again to FIG. 7, a user can follow a similar procedure to expose and access the cables 4910 and 4920 and accessory attachments 4945, 4955, and 4965.

Routing cables through the ridges to interconnect active system components has a number of advantages. For example, the cabling is protected from the environment outside the helmet which allows more lightweight cables to be used as compared to cables located on the outside of the helmet. The cabling on helmet 4000 is also neater and more organized than cabling disposed on the outside of a known helmet system. Because the cabling and accessory interfaces are reconfigurable, a data and communications network on the helmet can be changed, repaired, and upgraded when required or desired.

Figure 8:
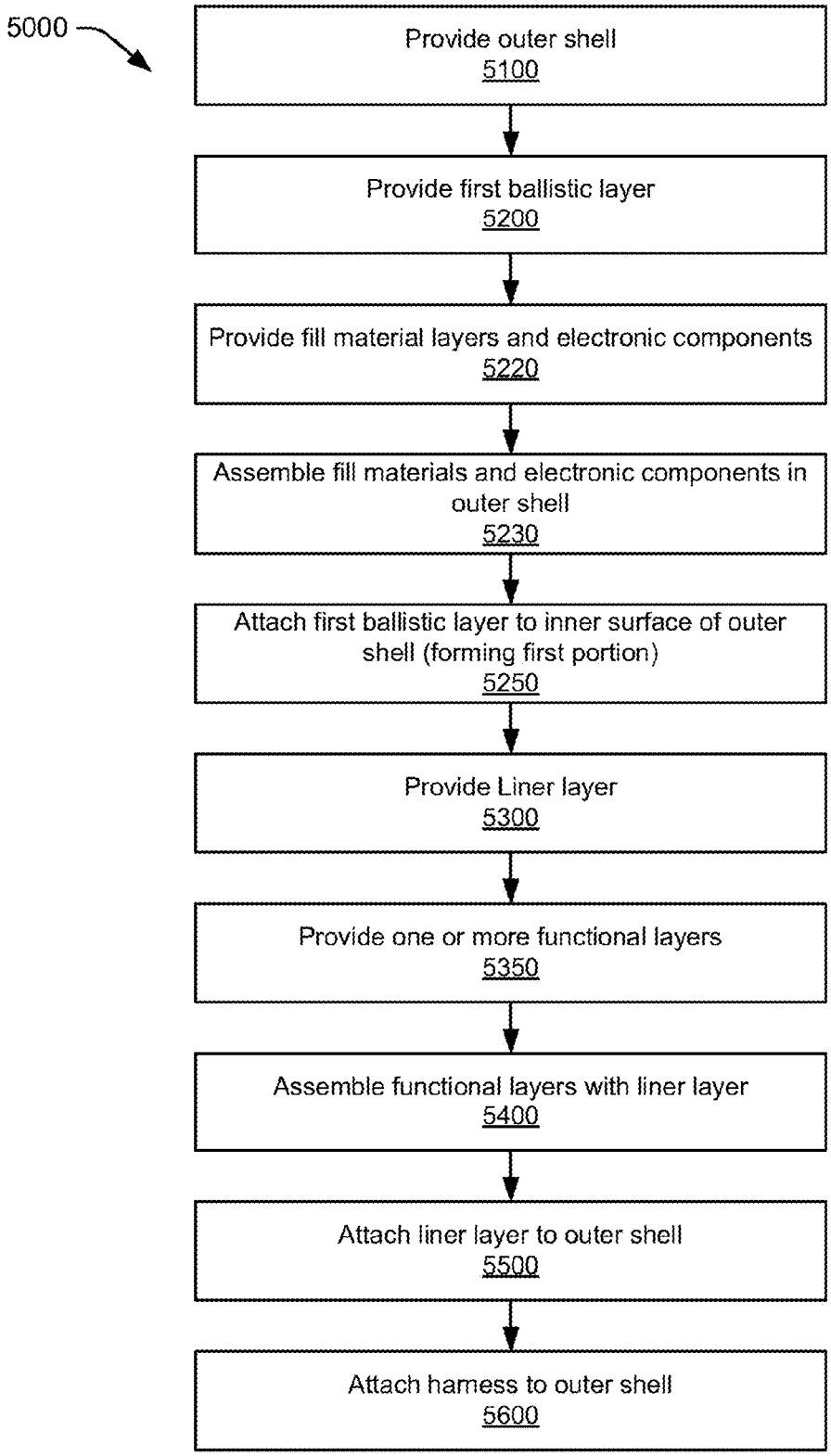
FIG. 8 is a process flow depicting an exemplary manufacturing and assembly process for exemplary embodiments of a helmet.

Referring to FIG. 8, a flow chart describing an exemplary, non-limiting, process 8000 for manufacturing and/or assembling any one of helmets 1000, 2000, and 4000 is depicted.

An outer shell, for example outer shell 1110, 2110, or 4110, is provided at step 5100. The outer shell is manufactured separately from other components of the helmet. The outer shell is made from a rigid material, for example from a composite material that includes carbon fibers. The outer shell can be manufactured using a forming process and can be formed with complex geometry including ridges and features for mounting accessories and electronic interfaces.

At step 5200, a first ballistic layer, for example first ballistic layer 1120 or 2120 is provided. In non-limiting exemplary embodiments, the first ballistic layer is manufactured with multiple layers of UHMPE material using one or more of a compression molding, forming, and deep-drawing process. In some embodiments, the ballistic layer includes one or more layers comprising other materials, for example carbon fiber and/or Aramid. In an alternative embodiment, a first ballistic layer is not provided and the helmet is assembled without a first ballistic layer.

At step 5220, one or more ridge fill layers, for example one or more of ridge fill layers 1132, 1142, 1152, 4132, 4152, and 4154, are optionally provided. One or more electronic components are optionally provided; for example, one or more of: a rear module or battery pack 4930; cables 1910, 1920, 4910 and 4920; an HUD interface device 4950; and one or more accessory attachments 1945, 4945, and 4965. Ridge fill layers can include strips of ballistic protection material similar to the first ballistic layer. One or more ridge fill layers may include a stiffening material; for example, a rigid foam material, which may not provide significant ballistic protection. The stiffening material may be provided as a pre-formed strip or as a curable composition such as a liquid spray foam that can be applied in a liquid state and cured in situ. The electronic components can include cables, including one or more of communication, power, or combination communication and power cables. The electronic components can include one or more electronic interface devices. The electronic components can include one or more pre-assembled electronic systems, for example a preassembled HUD system comprising a rear module, cable routing, and an HUD interface.

At step 5230, the optional ridge fill layers and electronic components, if provided, are assembled onto the outer shell. The ridge fill layers can be permanently or removably adhered to the outer shell under one or more ridges or formed in place within a cavity formed by a ridge. The electronic components can be assembled into receptacles formed in the outer shell, with cables routed through ridges formed in the outer shell.

At step 5250, the first ballistic layer is attached to the inner surface of the outer shell. The first ballistic layer may be permanently bonded to the outer shell or may be removably bonded to the outer shell. Any suitable means may be used to attach the first ballistic layer to the outer shell so that it remains in place until and if a user desires to remove it. For example, the first ballistic layer may be attached to the outer shell by a bead of adhesive material at a peripheral edge of the first ballistic layer wherein a user can cut through the adhesive material to remove the first ballistic layer. The first ballistic layer can be attached to the outer shell with one or more fasteners, for example with a hook and loop fastener system or with a plurality of mechanical fastener devices. In an alternative embodiment, wherein a first ballistic layer is not provided, a layer of non-ballistic material may be assembled onto the inner surface of the outer shell to cover the ridge layers and electronics.

At step 5300, a liner layer, for example liner layer 1210 or 2210 is provided. In a non-limiting example, the liner layer may be manufactured from an expanded foam material, for example EPP, using an injection molding process. The liner may be provided as a unitary piece or may include multiple parts, for example multiple comport pads and/or suspension straps. In some embodiments, the liner includes a fit system attached to the liner. In some embodiments, the liner and optional fit pads and/or fit system, are provided in a pre-assembled form.

At step 5350, one or more functional layers, for example one or more of functional layers 1220, 1230, 2220, 2230, are provided. An exemplary ballistic protection functional layer is formed in a manner similar to that described to form the first ballistic layer. Other functional layers, for example impact protection, shock wave mitigation, or honeycomb cooling layers, may be formed using a known molding or pressing process. In some embodiments, one or more of these and other functional layers, for example antennas and energy storage devices, are provided in a pre-assembled form.

At step 5400, one or more functional layers are assembled onto the liner. Alternatively, in some embodiments, no functional layers are assembled onto the liner.

At step 5500, the liner is attached to the outer shell. Step 5500 can include assembling one or more helmet connectors onto one or more of the outer shell and the liner. For example, referring to FIG. 3, front helmet connectors 1400 are assembled into front helmet connector recesses 1214 of the liner layer 1210 and attached to outer shell 1110 and, referring to FIG. 5, front helmet connector liner portions 2810 and rear helmet connector liner portions 2510 are assembled onto liner 2210.

At step 5600, a harness, for example harness 1710, is attached to the outer shell. Attaching the harness to the outer shell can include attaching one or more harness attachments, for example harness front attachments 1610 and harness rear attachments 1620, to the outer shell and attaching the harness to the harness attachments.

Although the steps of process 8000 are presented in a particular order, the process may be completed with variations in the ordering of the steps without deviating from the inventive concepts described herein. For example, a harness may be assembled onto the outer shell before the liner layer is assembled to the outer shell.

Referring now to FIG. 9, an exemplary embodiment of a helmet 6000 is shown. The helmet 6000 is shown in a closed configuration. The helmet 6000 includes an outer shell 6110 that includes a top ridge 6112, two side ridges 6113, a rear ridge 6114, and a front mount 6115. Accessory attachments 6945 are disposed on the top ridge 6112 and side ridge 6113. The helmet includes a liner 6210, a harness 6710, and one or more comfort pads 6800, which are attached to an inner surface of the liner. The helmet includes two harness front attachments 6610, two harness rear attachments 6620, two front helmet connectors 6400, and two rear helmet connectors 6500. A rotational axis 6300 passes through each of the two front helmet connectors 6400. The two front helmet connectors 6400 are aligned along the rotational axis 6300.

The outer shell 6110 is configured similarly to outer shell 1110, depicted for example in FIG. 1. The outer shell 6110 is formed from one or more rigid materials. In some embodiments, the outer shell 6110 is formed from one or more rigid composite materials, for example one or more composite materials discussed in relation to outer shell 1110. Some exemplary, non-limiting methods useful for forming an outer shell comprising one or more composite materials include hand layup, vacuum bagging, autoclave, and resin transfer molding (RTM), although any suitable known composite material forming process may be used. An exemplary additional or alternative embodiment of an outer shell 6110 may be formed from one or more plastic materials. Some exemplary, non-limiting methods useful for forming an outer shell 6110 comprising one or more plastics include those discussed in relation to forming outer shell 1110.

Advantageously, the outer shell 6110 can be formed separately from other components of the helmet 6000. Forming the outer shell separately allows molded-in or formed features to be created on the outer shell, unlike known helmets wherein a rigid outer shell is formed contemporaneously with other components such as one or more layers of ballistic protection material. Molded-in or formed features include the top ridge 6112, the rear ridge 6114, and each of the side ridges 6113, which are formed as protrusions from the outer shell 6100. The ridges provide extra rigidity to the outer shell 6110 which can increase its resistance to blunt impacts.

Additional molded-in features include attachment features for attaching the front mount 6115 and ridge accessory attachments 6945 to the helmet 6000. Each of the front mount 6115 and one or more side ridge accessory attachments 6945 can include a mechanical or electro-mechanical interface for attaching one or more active system components to the helmet 6000. An exemplary electro-mechanical interface includes electrical connectors for one or more of power and data. In an example embodiment, the front mount 6115 includes a front mount interface 6125.

One or more active system components (not shown) can be attached to the front mount 6115. Example active system components that can be attached to the front mount 6115 include, but are not limited to, a night vision viewing device and an augmented reality display visor.

In embodiments, the ridge accessory attachments 6945 include mechanical features for attaching one or more active system accessories (not shown) to the helmet 6000 as well as one or more receptacles for mounting electronic connectors to interface with the one or more active system accessories. Non-limiting examples of active system components that can be attached to accessory attachment 6945 include strobes, headsets, cameras, illumination systems, identification friend or foe (IFF) systems, and laser detection systems.

In embodiments, additional or alternative molded-in features can be formed on the outer shell 6110. For example, additional accessory attachments 6945 for mechanical and electronic connectors and for electronic components can be provided on one or more of the ridges 6112, 6113, and 6114.

The top ridge 6112 extends along a top surface of the outer shell and extends generally from a front portion of the outer shell to a rear portion of the outer shell. One side ridge 6113 is disposed on each of a left and a right side of the outer shell. The side ridges 6113 each extend from a front portion of the outer shell towards a rear portion of the outer shell. The rear ridge 6114 extends from left to right across a rear portion of the outer shell. Each of the top ridge 6112, side ridges 6113, and rear ridge 6114 define a hollow cavity conforming to the shape of the ridge beneath an outer surface 6116 of outer shell 6110.

The liner 6210 is disposed in helmet interior 6770. In some exemplary embodiments, the liner 6210 is formed from materials and using methods substantially similar to those disclosed in relation to liner 1210, previously described in relation to FIGS. 1 through 4.

The liner 6210 can further include one or more comfort pads 6800; for example, one or more comfort pads that may be permanently or removably attached to an inner surface of the liner. Exemplary, non-limiting embodiments of comfort pads 6800 include combinations of foams and textiles and can include one or more gels, visco-elastic materials, and active polymers. In non-limiting exemplary embodiments, comfort pads 6800 are manufactured using one or more of die-cutting, stitching, compression forming, and ultrasonic welding.

The front helmet connectors 6400 and rear helmet connectors 6500 attach the liner 6210 to the outer shell 6110. Although the present exemplary embodiment of a helmet 6000 includes two front helmet connectors 6400 and two rear helmet connectors 6500, embodiments of helmets that include more or fewer helmet connectors are anticipated by the technology described herein. Additional exemplary embodiments can include, for example, one front helmet connector, one rear helmet connector, three or more front helmet connectors, and/or three or more rear helmet connectors; for example, four or six rear helmet connectors.

In some embodiments, the liner 6210 functions as a suspension system. Some embodiments of the helmet 6000 include a fit system (not shown) attached to the liner 6210 and/or to the harness 6710. The fit system includes one or more adjustable components, for example a known fit dial system, for modifying the fit on the user's head. It is noted that a helmet 6000 can be configured without a fit system without deviating from the technology described herein.

The two harness front attachments 6610 and two harness rear attachments 6620 are each attached to the outer shell 6110. In a non-limiting example, the harness front and rear attachments are each attached to the outer shell by a threaded connector that is screwed into mating threads (not shown) formed in the outer shell or added to the outer shell following initial forming of the outer shell. In some embodiments, the mating threads include threaded inserts assembled into holes formed in the outer shell 6110.

The harness 6710 is attached to the outer shell via the front and rear harness attachments. The harness 6710 holds the helmet 6000 on a user's head. Advantageously, the harness rear attachments 6620 are located on a rearward portion of the outer shell 6110. When the helmet 6000 is worn by a user, the rearward location of the rear helmet attachments provides greater front-to-back stability of the helmet as compared to helmets with rear harness attachments disposed in a more forward position or on the sides of a helmet. This is particularly advantageous when a user mounts one or more active system components on the front or rear of the helmet 6000.

Because the harness 6710 is attached, via the harness attachments 6610 and 6620, to the outer shell 6110, the harness aids in holding the liner 6210 in place when the helmet 6000 is worn by a user. Although the present exemplary embodiment of the helmet 6000 includes two harness front attachments 6610 and two harness rear attachments 6620, embodiments of helmets that include more or fewer harness attachments are anticipated by the technology described herein.

Referring now to FIG. 10, the helmet 6000 in shown in an open configuration. The harness, harness attachments, and comfort pads are omitted for clarity.

Referring now to FIG. 10, the helmet 6000 is shown in an open configuration wherein a second portion 6200, including liner 6210, has been rotated relative to a first portion 6100 to expose a functional layer cavity 6216 into which one or more functional layers may be disposed. The helmet 6000 includes components described in relation to FIG. 9, wherein like components are labeled with like numbers.

The first portion 6100 includes the outer shell 6110 and a first ballistic layer 6120. The first ballistic layer 6120 includes an inner surface 6122 and an outer surface (not shown). The outer shell 6110 includes an inner surface 6117. The first portion 6100 includes a first ballistic layer 6120 attached to the inner surface 6117 of the outer shell 6110. Referring now to FIGS. 2A, 2B, 3, 4, and 10, the first ballistic layer 6120 is substantially similar in form, construction, and disposition to first ballistic layer 1120. In alternative embodiments, not shown, the first portion 6100 does not include a first ballistic layer 6120.

Returning now to FIG. 10, and as previously disclosed, the outer shell 6110 is formed with multiple ridges including top ridge 6112, side ridges 6113, and rear ridge 6114. The ridges form ridge cavities (not shown) between the outer shell 6110 and the first ballistic layer 6120. As described previously, for example in relation to FIGS. 2A and 3, one or more ridge fill materials may be disposed in each of the ridge cavities to further increase the stiffness and strength of the outer shell and/or to add ballistic protection to the outer shell. The cavities are also useful as conduits for cables; for example, as conduits for one or more of communication and power cables.

Referring once again to FIG. 10, the second portion 6200 includes the liner 6210. The liner 6210 includes a liner outer surface 6214 and a liner lip 6212 that substantially surrounds the liner outer surface 6214, thereby forming the functional layer cavity 6216, which is configured to receive one or more functional layers. When the helmet 6100 is in a closed configuration, as illustrated in FIG. 9, the first ballistic layer inner surface 6122 encloses the functional layer cavity 6216. In this manner, and referring now to FIGS. 2A, 2B, 3, and 10, the functional layer cavity 6216 is substantially similar to functional layer cavity 1250 and is configured to hold one or more functional layers disposed within the functional layer cavity 6216, for example one or more of functional layers 1220 and 1230, including, for example, one or more of the functional layers described in Table 1.

In a further exemplary embodiment, the functional layer cavity 6216 may be left empty, thereby providing an air space between the liner 6210 and the first ballistic layer 6120, or the outer shell 6110 in embodiments that do not include a first ballistic layer 6120. The air space has multiple useful properties; for example, as a conduit for the circulation and venting of hot or cold air and as a gap for decoupling the first portion 6100 from the liner 6210, thereby preventing or dampening the transmission of shock waves and impact-induced pressure waves through the structure of the helmet 6000 to a user's head.

Referring to FIGS. 9 and 10, the first portion 6100 and the second portion 6200 are rotatably joined together by front helmet connectors 6400. Each front helmet connector 6400 includes an outer connector head 6420 and an inner connector head 6422, which are joined together by a cylindrical front helmet connector post (not shown), for example a post having a cylindrical cross section shape. Each front helmet connector post has a post longitudinal axis aligned parallel to the length of the front helmet connector post and each post longitudinal axis is aligned with the rotational axis 6300. The outer connector heads 6420 are disposed on the outside of the outer shell 6110, the inner connector heads 6422 are disposed on the inside of liner 6120, and the connector posts pass through both the outer shell and the liner to join the first portion 6100 to the second portion 6200 and to enable rotational translation therebetween around the rotational axis 6300.

In other embodiments (not shown), the outer shell 6110 includes front helmet connector interfaces for attaching the front helmet connector posts to the outer shell. An example front helmet connector interface includes a threaded receptacle or boss comprising a threaded receptacle for interfacing with corresponding threads on a front helmet connector post. In alternative embodiments a front helmet connector interface can include one or more connectors or posts bonded to the inner surface 6117 of the outer shell 6110. Referring now to FIGS. 1, 3, and 10, the front helmet connectors 6400 join the first portion 6100 and the second portion 6200 together in a manner similar to that previously described in relation to the first portion 1100, second portion 1200, and front helmet connectors 1400.

Referring to FIG. 10, each rear helmet connector 6500 includes a rear helmet connector liner portion 6500A which is attached to the liner 6210 and a rear helmet connector outer shell portion 6500B which is attached to the outer shell 6110.

Each rear helmet connector liner portion 6500A includes a rear alignment portion 6520 and a rear connector flex portion 6510 which includes a rear connector release 6512 and a rear engagement portion 6514. In non-limiting embodiments, a rear helmet connector liner portion 6500A is formed separately from the liner 6210 for example, using an injection molding process or 3D printing, and is assembled onto the liner 6210; for example, using adhesive bonding or mechanical fastening. Exemplary rear helmet connector liner portions 6500A are formed from a plastic material and may include one or more metallic parts.

Each rear helmet connector outer shell portion 6500B includes a rear engagement portion receptacle 6516 and a rear alignment portion receptacle 6522. Each rear helmet outer shell portion 6500B is formed separate from, and attached to, the outer shell 6110. Example rear helmet outer shell portions 6500B may be formed from a plastic material, for example by injection molding or 3D printing, and may include one or more metallic parts. In a non-limiting embodiment, each rear helmet outer shell portion is disposed within a cavity formed under a rear portion of a side ridge 6113 and is attached to an inner surface of the cavity; for example, by adhesive bonding, overmolding, or using one or more mechanical fasteners. In another exemplary embodiment, a rear helmet connector outer shell portion 6500B, or portions thereof, may be formed as an integral portion of a molded outer shell 6110. In some embodiments, an engagement portion receptacle 6516 or an alignment portion receptacle 6522 includes a cavity in the outer shell for engaging with a corresponding rear engagement portion 6514 or rear alignment portion 6520. In other embodiments, the rear engagement portion receptacle 6516 includes a boss structure protruding from the inner surface 6117 of the outer shell 6110. The boss structure may be formed with the outer shell or may be bonded to the outer shell in a subsequent manufacturing step.

Each rear helmet rear engagement portion 6514 interfaces with a corresponding rear engagement portion receptacle 6516 in an engaged configuration to hold the helmet in a closed position. A user can at least partially disengage the first portion 6100 from the second portion 6200 to expose the functional layer cavity 6216, and any functional layers disposed therein, without using tools. To do so, the user can push on a rear connector release 6512 to cause the rear helmet connector flex portion 6510 to flex or otherwise elastically deform to thereby disengage the rear engagement portion 6514 from the rear engagement portion receptacle 6516. When the user disengages the two rear engagement portions 6514 from the two rear engagement portion receptacles 6516, the first portion 6100 and second portion 6200 can be rotated relative to each other around front helmet connectors 6400 and rotational axis 6300, to expose the functional layer cavity 6216.

A user then can remove one or more functional layers, replace one or more functional layers, or add one or more functional layers when the helmet 6000 is in an open configuration, such as the configuration illustrated in FIG. 10.

The user can close the helmet by rotating the first portion relative to the second portion 6200 around rotational axis 6300 until the rear helmet engagement portions 6514 engage with corresponding engagement portion receptacles 6516. Because, in some example embodiments, the liner 6210 comprises one or more non-rigid materials and therefore may be somewhat flexible, it may be difficult for a user to align the rear engagement portions 6514 with the rear engagement portion receptacles 6516. This problem is advantageously solved by rear alignment portions 6520 and corresponding rear alignment portion receptacles 6522. When a user closes the helmet, rear alignment portions 6520 interface with corresponding rear alignment portion receptacles 6522 and draw rear engagement portions 6514 into alignment with rear engagement portion receptacles 6516.

Referring now to FIGS. 11A and 11B, an exemplary liner 6210 is shown. The liner 6210 is shown in a top view in FIG. 11A and in a side perspective view in FIG. 11B. The liner 6210 includes an inner liner cushioning layer 6218 which is partially covered by a liner outer shell 6220. The liner outer shell 6220 includes multiple openings 6221 which each expose a portion of the liner cushioning layer 6218 and allow fluids, e.g. air and moisture, to enter, exit, and flow through the liner cushioning layer 6218. Openings in the liner outer shell 6220 include openings 6221 disposed on the liner outer surface 6214 and openings (not shown) disposed on a liner inner surface 6217 opposing the liner outer surface 6214. Additional embodiments of the liner 6120 can be formed without a liner outer shell 6220 without deviating from the technology described herein.

In a non-limiting exemplary embodiment, the liner cushioning layer 6218 is formed from a cushioning material; for example from one or more expanded foam materials, e.g., one or more of expanded polypropylene (EPP) or expanded polystyrene (EPS), formed, for example, using an injection molding or expansion process. In some exemplary embodiments, the liner cushioning layer 6218 includes one or more materials having a lattice or honeycomb structure; for example a lattice or honeycomb structure that is designed to deform under impact to absorb or dissipate pressure, formed, for example, using a 3D printing process or other manufacturing process. An exemplary honeycomb structure includes a welded tube material similar to that marketed by Koroyd, Le Triton, 5 Rue du Gabian, 98000 Monaco. An exemplary carbon-based lattice structure is manufactured by Carbon, Inc. An exemplary, non-limiting liner cushioning layer 6218 can include one or more active polymers that are configured to absorb and dissipate pressure; for example, one or more active polymers or a helmet liner system comprising one or more active polymers provided by D30, 7-8 Commerce Way, London, GB and/or Rheon, 26F Congress St, Suite 167, Saratoga Springs, NY.

In embodiments wherein the liner cushioning layer 6218 is partially or wholly encased by a rigid or semi-rigid liner outer shell 6220, the liner outer shell 6220 may be formed with a plastic material, for example with one or more of acrylonitrile butadiene styrene (ABS), poly-vinyl chloride (PVC), and polycarbonate (PC).

The liner 6210 includes multiple features configured to assist a user to position and removably attach one or more functional layers to the liner and thereby add or remove the one or more functional layers to the functional layer cavity 6216 and to the helmet 6000. These attachment features include a front functional layer tab receptacle 6222, two front attachment pads 6227, two rear attachment pads 6229, two front functional layer snap baskets 6224, and two rear functional layer snap baskets 6226. The front functional layer tab receptacle 6222 is disposed on a front portion of the liner 6210. The front functional layer tab receptacle 6222 includes a cavity configured to receive a corresponding tab disposed on a front functional layer.

The front attachment pads 6227 are each disposed on a rearward portion of the liner outer surface 6214. The front attachment pads are configured to interface with corresponding attachment pads of a front functional layer to removably attach the front functional layer to the liner 6120. The rear attachment pads 6229 are disposed on the liner outer surface 6214 further rearward as compared with a location of the front attachment pads 6227. The rear attachment pads 6229 are configured to interface with corresponding attachment pads of a rear functional layer to removably attach the rear functional layer to the liner 6120. Exemplary, non-limiting, front and rear attachment pads include re-closable fasteners; for example, hook and loop fasteners, e.g. Velcro fasteners provided by Velcro IP Holdings LLC, UK, mushroom headed fasteners, e.g. 8000 series fasteners provided by Central Tapes and Adhesives, LTD, West Midlands, UK, Dual Lock Reclosable Fasteners provided by 3M, opposing magnets or a magnet opposed to a ferromagnetic material, and LYNX Xolok fasteners provided by Chittenden Research and Development, LLC, Hinesburg, VT.

The front functional layer snap baskets 6224 are disposed on opposing rearward sides of the liner outer surface 6214 and are configured to interface with corresponding snap post portions of a front functional layer to removably attach the front functional layer to the liner 6120. The rear functional layer snap baskets 6226 are disposed on opposing sides of the liner outer surface 6214 rearward of the front functional layer snap baskets 6224. The rear functional layer snap baskets 6226 are configured to interface with corresponding snap post portions of a rear functional layer to removably attach the rear functional layer to the liner 6120. In additional embodiments, the liner 6120 includes one or more suitable mechanical fasteners known to one skilled in the art, in addition to or instead of snap baskets and corresponding snap posts.

Additional exemplary embodiments of liner 6210 (not shown) can each include more or fewer functional layer snap baskets 6224, 6226, more or fewer attachment pads 6227, 6229, and/or more front functional layer tab receptacles 6222. For example, an additional exemplary embodiment of liner 6210 can include one, two, three, four, or six functional layer snap baskets, one, two three, four, or six attachment pads, and one or more front functional layer tab receptacles.

In addition, the liner lip 6212 is configured to help position and removably retain one or more front and rear functional layers within the functional layer cavity 6216.

FIG. 12 shows an exemplary snap attached front functional layer 6230 and rear snap attached functional layer 6240 in a bottom perspective view. The snap attached front functional layer 6230 includes an outer surface 6233 and an inner surface 6232. The rear snap attached functional layer 6240 includes an outer surface 6243 and an inner surface 6242.

Each snap attached functional layer includes attachment features configured to interface with corresponding attachment features of the liner 6120 to position the functional layer relative to the liner and to removably attach the functional layer to the liner. The snap attached front functional layer 6230 includes a front functional layer tab 6238 disposed on a front portion of the inner surface 6232 and two front functional layer snaps 6234, disposed on opposing sides of the front snap attached front functional layer 6230.

Referring now to FIGS. 11A, 11B, and 12, the front functional layer tab 6238 is configured to interface with the front functional layer tab receptacle 6222 of the liner 6210. The front two front functional layer snaps 6234 are each configured to interface with a corresponding front functional layer snap baskets 6224 of the liner 6210 to removably attach the snap attached front functional layer 6230 thereto. Each front functional layer snap 6234 includes a snap head portion 6235 and a snap post portion 6236. The snap head portions 6235 are disposed on the outer surface 6233 of the snap attached front functional layer 6230. The snap post portions 6236 are attached to the snap head portions 6235, pass through the snap attached front functional layer 6230, and protrude from the inner surface 6232 thereof.

The rear snap attached front functional layer 6240 includes two rear functional layer snaps 6244, disposed on opposing sides of the snap attached rear functional layer 6240. The two rear functional layer snaps 6244 are each configured to interface with a corresponding rear functional layer snap basket 6226 of the liner 6210 to removably attach the snap attached rear functional layer 6240 thereto. Each rear functional layer snap 6244 includes a snap head portion 6245 and a snap post portion 6246. The snap head portions 6245 are disposed on the outer surface 6243 of the snap attached rear functional layer 6240. The snap post portions 6246 are attached to the snap head portions 6245, pass through the snap attached rear functional layer 6240, and protrude from the inner surface 6242 thereof.

Additional exemplary embodiments of snap attached front functional layer 6230 (not shown) and pad attached rear functional layer 6240 (not shown) can each include additional front attachment layer tabs 6238, for example two of more functional layer tabs, more or fewer functional layer snaps 6234, 6244, for example one, three, four, or six functional layer snaps. Each front attachment layer tab 6238 is disposed to align with a corresponding front functional layer tab receptacle 6222 on a liner 6210. Each functional layer snap is disposed to align with a corresponding functional layer snap basket 6224 or 6226 disposed on liner 6210 when the snap attached functional layers are removably assembled on the liner 6210.

FIG. 13A shows a bottom view of a pad attached front functional layer 6250. FIG. 13B shows a bottom view of a pad attached rear functional layer 6260. The pad attached front functional layer 6250 includes an inner surface 6252, a front functional layer tab 6258 and two front liner attachment pads 6257, each disposed on a rearward portion of the inner surface 6252. The pad attachment rear functional layer 6260 includes an inner surface 6262, two rear liner attachment pads 6269, each disposed on a forward portion of the inner surface 6262.

Referring now to FIGS. 11A, 11B, 13A, and 13B, the front and rear liner attachment pads 6257 and 6269 are each configured to interface with a corresponding front and rear attachment pad 6227 and 6229, respectively, of the liner 6210 to removably attach the pad front or rear functional layers to the liner. Exemplary front and rear liner attachment pads 6257 and 6269 include those previously described in relation to front and rear attachment pads 6227 and 6229.

The front functional layer tab 6258 of the tab attached front functional layer 6250 is configured to interface with the functional layer tab receptacle 6222 of the liner 6210 to help align and removably attach the pad attached front functional layer. Additional exemplary embodiments of pad attached front functional layer 6250 (not shown) and pad attached rear functional layer 6260 (not shown) can each include more or fewer liner attachment pads 6257, 6269; for example, one, three, four, or six liner attachment pads wherein each liner attachment pad is disposed to align with a corresponding liner pad 6227 or 6229 disposed on liner 6210 when the pad attached functional layers are removably assembled on the liner 6210.

Front and rear snap attached functional layer 6230, 6240 and front and rear pad attached functional layers 6250, 6260 can include any type or configuration of functional layer described herein. Exemplary functional layer types are described, for example, in Table 1.

Referring to FIGS. 14A, 14B, and 14C, and referring also to FIGS. 10, 11A, 11B, and 12, an exemplary method for assembling the snap attached front functional layer 6230 onto the liner 6210 is illustrated. Although an entire helmet 6000 is not shown in FIGS. 14A, 14B, and 14C, it is understood that liner 6210 represents a liner component of the second portion 6200 of the helmet 6000 and that the methods shown can be used to attach a snap attached front functional layer to the liner 6210 while the helmet 6000 is in the open configuration shown in FIG. 10, with the first portion 6100 translated relative to the second portion 6200 to expose the functional layer cavity 6216 for attachment and removal of one or more functional layers.

A problem that may be encountered by a user during assembly of a front functional layer, for example but not limited to a snap attached front functional layer 6230, onto liner 6210 when the helmet in the open configuration, includes the user being unable to see or easily access the front of the liner 6210 to assemble a front functional layer thereto. To solve this problem, front functional layer tabs 6238 and 6258 are provided which interface with the functional layer tab receptacle 6222 of the liner 6210. This enables a user to position and partially secure a front functional layer tab at least partially by feel.

Another problem that may be encountered by a user during assembly of a front functional layer, for example but not limited to a snap attached front functional layer 6230, onto liner 6210 when the helmet in the open configuration, is that particular functional layer may be flexible and as such may bunch up or otherwise not lie flat when positioned in the functional layer cavity 6216. This makes it difficult for a user to assemble the particular functional layer onto the liner 6210. In a non-limiting example, a desirable characteristic of an impact functional layer may include that it can be to be folded, rolled, or otherwise deformed for storage and/or transport outside of the helmet 6000 without damaging the impact functional layer. An elastically deformable impact functional layer, for example one configured as a lattice structure of an elastomeric material, may provide the desired properties but may not have sufficient independent form to easily positioned and maintained in positional within the functional layer cavity 6216. This problem is advantageously solved by fastening devices such as snap baskets 6224, 6226 and corresponding snaps 6234, 6244 to aid in assembly one or more functional layers onto liner 6210, within the functional layer cavity 6216.

As shown in FIG. 14A, a user first positions the front functional layer 6230 over the liner 6210, with the front functional layer tab 6238 approximately aligned with the front functional layer tab receptacle 6222 of the liner 6210.

As shown in FIG. 14B, the user then pulls the snap attached front functional layer 6230 rearward to engage the front functional layer tab 6238 with the front functional layer tab receptacle 6222, thereby partially securing the snap attached front functional layer 6230 on the liner 6210.

The user then pulls the snap attached front functional layer 6230 rearward and downward to bring the inner surface 6232 of the snap attached front functional layer 6230 into contact with the outer surface of the liner 6210. The user then engages front functional layer snaps 6234 with front functional layer snap baskets 6224 to secure the snap attached front functional layer 6230 in place, as shown in FIG. 14C.

Referring to FIGS. 12 and 14C, when a snap post portion 6236 of a front functional layer snap 6234 is removably assembled into a front functional layer snap basket 6224 of the liner 6210, the corresponding snap head portion 6235 pushes against the outer surface 6233 of the snap attached front functional layer 6230 to bring the inner surface 6232 of the snap attached front functional layer into contact with the outer surface 6214 of the liner 6210.

The illustrated assembly method is particularly useful for assembling a flexible snap attached front functional layer 6230; for example, an impact functional layer, onto the liner 6210 because a user, after securing the front functional layer tab 6238 in the front functional layer tab receptacle 6222, can pull and stretch the flexible functional layer to align the front functional layer snaps 6234 with the front functional layer snap baskets 6224. Engagement of the front functional layer snaps 6234 with the front functional layer snap baskets 6224 maintains the snap attached front functional layer 6230 in position despite any tension imparted on the functional layer due to the stretching.

Referring to FIGS. 15A and 15B, and referring also to FIGS. 11A, 11B, and 12, an exemplary method for removably assembling snap attached rear functional layer 6240 onto the liner 6210 is shown. A user aligns the rear functional layer snaps 6246 with the rear functional layer snap baskets 6266, as shown in FIG. 15A. The user then removably attaches the snap attached rear functional layer 6240 onto the liner 6210 by interfacing the rear functional layer snaps 6246 with the rear functional layer snap baskets 6266, as shown in FIG. 15B. This method may be particularly useful for attaching a flexible rear functional layer to the liner 6210. A user can partially attach the snap attached rear functional layer 6240 using a first rear functional layer snap 6246, stretch the rear functional layer over the liner outer surface 6214, and then use a second rear functional layer snap 6246 to finish attaching the snap attached rear functional layer 6240.

FIG. 16 shows a pad attached front functional layer 6250 and a pad attached rear functional layer 6260 removably attached to the liner 6210. The pad functional layers can be attached to the liner 6210 using methods similar to those described for snap attached front and rear functional layers 6230 and 6240, as illustrated in FIGS. 14A, 14B, 14C, 15A, and 15B. In particular, and referring now to FIGS. 11A, 11B, 13A, 13B and 16, the pad attached functional layers 6250 and 6260 are removably attached to the liner 6210 by interfacing front attachment pads 6227 and rear attachment pads 6229 comprising the liner 6120 with corresponding front liner attachment pads 6257 and rear liner attachment pads 6269 of the pad attached front functional layer 6250 and pad attached rear functional layer 6260, respectively. A front functional layer tab 6258 of the pad attached front functional layer 6250 can be interfaced with the functional layer tab receptacle 6222 of the liner 6120. This method of attachment may be particularly advantageous for attaching functional layers that do not require a user to stretch or otherwise deform the functional layer; for example for ballistic functional layers, stiff or semi-rigid impact functional layers, and power storage functional layers.

Referring now to FIGS. 9, 10, 15B, and 16, a user can removably attach one or both of the snap attached front and rear functional layers 6230 and 6240 and/or pad attached front and rear functional layers 6250 and 6260 to the liner 6210 while the helmet 6000 is in an open configuration, as illustrated in FIG. 10. The user can then rotate the first portion 6100 and 6200 relative to each other to place the helmet 6000 in a closed configuration, as illustrated in FIG. 9, with the functional layers installed in the helmet. A user can remove and/or replace one or more of the functional layers by returning the helmet to an open configuration and disengaging one or both of the front and rear functional layers from the liner 6120.

Referring now to FIGS. 15B and 16, although each illustrated embodiment includes two functional layers 6230 and 6240 or 6250 and 6260, the helmet 6000 can include more or fewer functional layer components without deviating from concepts of the disclosed technology. For example, the helmet can include a single functional layer, or three or more functional layers, for example 3, 4, 5, or 6 functional layers, each of which can be disposed between the liner 6210 and the first portion 6100. In an alternative embodiment that does not include a first ballistic layer (not shown), the functional layers are disposed between the liner 6210 and the outer shell 6110. It is also recognized that although each illustrated embodiment includes a front and rear functional layer of the same type, i.e. snap attached front and rear functional layers 6230 and 6240 and pad attached front and rear functional layers 6250 and 6260, a user can mix and match types for functional layers, for example a user can configure the helmet with a pad attached front functional layer 6250 and with a snap attached rear functional layer 6240.

7 EXAMPLES

The following Examples are provided to illustrate certain aspects of the present invention and to aid those of skill in the art in the art in practicing the invention. These Examples are in no way to be considered to limit the scope of the invention in any manner.

A first exemplary embodiment of a helmet 1000 includes a first non-ballistic layer, for example an outer shell 1110, a second layer, for example a removable functional layer 1220 or 1230 (e.g., a removable ballistic layer) disposed inside the first layer and a third layer, for example a liner 1210 disposed inside of the second layer. The third layer 1210 is removably attached to the first layer 1110 and holds the second layer 1220 or 1230 to the helmet. In some embodiments, the second layer 1220 or 1230 directly contacts the first layer 1110. The helmet can further include a fourth layer disposed between the first layer and the second layer, for example a first ballistic layer 1120.

A second exemplary embodiment of a helmet 1000 includes a first non-ballistic layer, for example an outer shell 1110, a removable ballistic layer, for example one or more of front functional layers 2120 and rear functional layer 1230 configured as a ballistic layer, a retention system 1710 attached to the first non-ballistic layer, and a liner 1210 internal to the removable inner ballistic layer. The helmet can further include a non-removable ballistic layer, for example a first ballistic layer 1120. In some embodiments, the retention system 1710 is attached to an edge or inside surface of the non-ballistic layer 1110. In some embodiments, a fit system 1720, for example a dial liner, is also attached to an edge or inner surface of the non-ballistic layer 1110.

A third exemplary embodiment of a helmet 1000 includes a ballistic layer, for example a first ballistic layer 1120, that includes an edge surface 1126 disposed between an outer surface 1124 and an inner surface 1122. The helmet also includes an inner layer, for example a liner 1210 that is positioned internally relative to the first ballistic layer 1120. The inner layer has a lip 1212 which covers at least a portion of the ballistic protective layer edge surface 1126. In an embodiment, the helmet includes two ballistic layers (first ballistic s layer 1120 and one or more functional layers 1220, 1230 configured as a ballistic layer), each of which includes an edge surface, for example 1126 and 1236. The lip 1212 of the inner layer 1210 can cover at least a portion of both edge surfaces 1126 and 1236. In an embodiment, the inner layer 1210 attaches to the helmet to secure a ballistic layer, for example an inner functional layer 1220 and/or 1230 configured as a ballistic layer. In a particular exemplary embodiment, the inner layer 1210 is attachable to the helmet with a basket/post attachment arrangement 2400.

A fourth exemplary embodiment of a helmet 1000 includes an outer ballistic layer, for example a first ballistic layer 1120, a first inner layer of a first type, for example a first functional layer 1220 or 1230 of a first type and a second inner layer of a second, non-ballistic, type, for example a second functional layer 1220 or 1230 that is not configured to provide ballistic protection. A single one of the first inner layer and the second inner layer can be attached to the helmet at a particular time. In some embodiments, the first inner layer is non-compressible. In an embodiment, the helmet further includes a third inner layer, for example a liner 1210 that is attached to the helmet to secure the first or second inner layer to the helmet. The helmet may include a non-ballistic layer, for example outer shell 1110, disposed outward relative to the outer ballistic layer 1120.

A fifth exemplary embodiment of a helmet 1000 includes an outer layer, for example an outer shell 1110, a first internal ballistic plate, for example a first functional layer 1220 configured as a ballistic layer, having a first edge 1228, a second internal ballistic plate, for example a second functional layer 1230 configured as a ballistic layer, having a second edge 1238. The helmet further includes a ballistic portion comprising ballistic material, for example a rear ridge ballistic layer 1150, overlapping at least a portion of both the first edge 1228 and the second edge 1238. The ballistic portion 1150 is internal to the outer layer. In some embodiments, the outer layer 1110 is non-ballistic. The first and second internal ballistic plates 1220 and 1230 may be removable from the helmet or may be permanently attached to the helmet. In some embodiments, the first and second internal ballistic plates 1220 and 1230 abut one another. In other embodiments, the first and second internal ballistic plates 1220 and 1230 form a gap 1240 between the plates. In further embodiments, the first and second internal ballistic plates 1220 and 1230 overlap one another. In an embodiment, the ballistic portion 1150 is formed as a strip of material disposed extending lengthwise in a direction along which the first and second edges extend.

A first exemplary method for interchanging layers, for example one or more functional layers 1220 and 1230, in a helmet 1000 that includes an outer layer, for example an outer shell 1110 or first ballistics layer 1120, includes removing a first inner layer of a first type, the first layer being ballistic and inserting and securing a second inner layer of a second type, the second inner layer being non-ballistic. The outer layer may be ballistic 1120 or non-ballistic 1110. The method may further include at least partially detaching an inner layer, for example a liner 1120, from the outer layer, for example 1110, prior to removing the first interchangeable layer (a first one of 1220 and 1230) and reattaching the inner layer 1120 to the outer layer 1110 to secure the second interchangeable layer (a second one of 1220 and 1230).

A method for adding a layer, for example a functional layer 1220 or 1230, to a helmet 1000 that includes a first ballistic layer, for example first ballistic layer 1120, and a helmet interior includes inserting a second ballistic layer, for example a functional layer 1220 or 1230 configured as a ballistic layer, without any padding attached, into the helmet interior. The method further includes subsequently inserting a liner 1210 internal to the second ballistic layer 1220 or 1230 and attaching the liner 1210 to the helmet. In an embodiment, attaching the liner 1210 to the helmet can include attaching the liner 1210 to an outermost layer of the helmet, for example to an outer shell 1110 of the helmet. In an embodiment, attaching the liner 1210 to the helmet includes attaching the liner to a non-ballistic layer 1110 that is disposed outside of the first ballistic layer 1120. The method may further include, at least partially detaching the liner 1210 from the helmet, inserting the second ballistic layer, and subsequently reattaching the liner to the helmet.

The technology described herein enables a user to configure an exemplary helmet for a particular use, for example for a particular mission type, and to reconfigure the helmet as needed or desired. For example, a warfighter can configure a helmet with one or more impact protection functional layers in preparation for parachuting or otherwise descending to a target location and subsequently reconfigure the helmet with one or more ballistic protection layers prior to entering a location where gunfire may be expected.

It will also be recognized by those skilled in the art that, while the invention has been described above in terms of exemplary embodiments of the inventive technology, it is not limited thereto. Various features and aspects of the above-described exemplary embodiments may be used individually or jointly. Further, although the exemplary embodiments have been described in the context of their implementation in particular environments, and for particular applications (e.g. for bump helmets and ballistic protection helmets which may be used in military applications) those skilled in the art will recognize that its usefulness is not limited thereto and that the present embodiments of the inventive technology can be beneficially utilized in any number of environments and implementations where it is desirable to provide a reconfigurable helmet system wherein one or more of protection levels, protection types, functional components, and active systems can be easily added, removed, or modified by a user to meet the need of particular use case. Accordingly, the claims set forth below should be construed in view of the full breadth and spirit of the exemplary embodiments as disclosed herein.

What is claimed is:

1. A helmet, comprising:

a first portion including an outer shell;

a second portion including a liner layer;

wherein the outer shell comprises one or more protrusions formed on the outer shell, wherein each protrusion forms a cavity conforming to a shape of the protrusion beneath an outer surface of the outer shell; and wherein the outer shell comprises one or more accessory attachments, further comprising:

one or more electrical conductors for one or more of communication and power disposed in at least one of the one or more cavities; and one or more accessory attachment interfaces;

wherein each of the one or more accessory attachment interfaces is mounted on the outer shell at an accessory attachment; and wherein at least one of the one or more accessory attachment interfaces is electrically connected to at least one of the one or more electrical conductors.

2. The helmet of claim 1, wherein the outer shell is a non-ballistic layer and the first portion includes a first ballistic layer disposed adjacent to an inner surface of the outer shell; and wherein one or more of the electrical conductors are disposed between the first ballistic layer and the outer shell in a cavity formed between the first ballistic layer and the outer shell.

3. The helmet of claim 2, wherein the first ballistic layer includes a first outer surface, a first inner surface, and a first edge surface disposed between the first outer surface and the first inner surface;

wherein the outer surface of the first ballistic layer is disposed adjacent to an inner surface of the outer shell;

wherein the liner comprises an outer lip and the outer lip covers at least a portion of the first edge surface of the first ballistic layer.

4. The helmet of claim 1, wherein:

the first portion is attached to and translates relative to the second portion to enable a user to dispose at least one removable ballistic layer between the liner layer and the first portion; and the first portion is at least partially detachable from the second portion without tools to enable the first portion to translate relative to the second portion.

5. The helmet of claim 4, wherein:

the helmet includes a connector that connects the outer shell to the second portion to attach the first portion to the second portion; and the connector enables the first portion to rotate relative to the second portion to expose the at least one removable ballistic layer for removal by the user.

6. The helmet of claim 5, wherein the connector includes a post that extends from the outer shell through the liner layer, wherein the first portion rotates relative to the second portion around the post.

7. The helmet of claim 1, wherein;

the first portion is attached to and translates relative to the second portion to enable a user to dispose at least one removable functional layer between the liner layer and the first portion; and the at least one removable functional layer includes at least one of an antenna, an energy storage device, and a sensor.

8. The helmet of claim 2, wherein the first ballistic layer is at least partially removable from the outer shell to enable removal, addition, repair, or replacement of the one or more electrical conductors and the one or more accessory attachment interfaces.

9. The helmet of claim 8, further comprising a pre-assembled electronics system comprising the one or more electrical conductors and the one or more accessory attachment interfaces, wherein the first ballistic layer is at least partially removable from the outer shell to enable installation and removal of the pre-assembled electronics system.

10. The helmet of claim 2, wherein the one or more protrusions comprise one or more ridges formed on the outer shell and extending from a rear portion of the helmet toward a front portion of the helmet and comprising a ridge cavity in which at least one of the one or more electrical conductors is disposed between the outer shell and the first ballistic layer.

11. The helmet of claim 1, wherein the helmet further includes a harness attachment attached to the outer shell, a harness system attached to the harness attachment, the harness system configured to retain the helmet on the head of a user; and a fit system detachably attached to the helmet, independently of the harness system, and configured to adjust a fit of the helmet on the head of the user.

12. The helmet of claim 1, wherein at least one of the cavities includes a fill material disposed therein.

13. The helmet of claim 1, further comprising a module comprising one or more of a processor and a power source;

wherein at least one of the one or more electrical conductors connects the module to at least one of the one or more accessory attachment interfaces for one or more of providing power to the accessory attachment interface and routing communications to and from an accessory electrically interfaced with one of the one or more accessory attachment interfaces.

14. The helmet of claim 1, wherein the one or more accessory attachment interfaces include at least one selected from the group consisting of a heads up display (HUD) interface and a front mount interface.

15. The helmet of claim 1 further comprising an active system accessory that is removably attachable to the helmet;

wherein at least one of the one or more accessory attachment interfaces comprises an electro-mechanical interface, wherein the electro-mechanical interface comprises:

an electrical interface for conductively coupling to at least one of the one or more electrical conductors and to the active system accessory; and a mechanical interface for removably coupling the active system accessory to the helmet.

16. A helmet, comprising:

a first portion including an outer shell;

a second portion including a liner layer;

wherein the first portion is attached to and translates relative to the second portion to enable a user to dispose at least one removable ballistic layer between the liner layer and the outer shell;

wherein the first portion is at least partially detachable from the second portion to enable the first portion to translate relative to the second portion;

the helmet includes a connector that connects the outer shell to the second portion to attach the first portion to the second portion; and the connector enables the first portion to rotate relative to the second portion to expose the at least one removable ballistic layer for removal by the user.

17. The helmet of claim 16 wherein the connector connects the outer shell to the liner to connect the first portion to the second portion.

18. The helmet of claim 16, wherein the outer shell comprises one or more accessory attachments, and wherein the outer shell comprises one or more ridges formed on the outer shell, wherein each ridge forms a ridge cavity beneath the ridge; further comprising:

one or more electrical conductors for one or more of communication and power disposed in at least one of the one or more ridge cavities; and one or more accessory attachment interfaces;

wherein each of the one or more accessory attachment interfaces is mounted on the outer shell at an accessory attachment; and wherein at least one of the one or more accessory attachment interfaces is electrically connected to at least one of the one or more electrical conductors.

19. The helmet of claim 18, further comprising a pre-assembled electronics system comprising the one or more electrical conductors and the one or more accessory attachment interfaces, wherein the first ballistic layer is at least partially removable from the outer shell to enable installation and removal of the pre-assembled electronics system.

20. The helmet of claim 18, wherein the outer shell is a non-ballistic layer and the first portion comprises the at least one removable ballistic layer disposed adjacent to an inner surface of the outer shell; and wherein the one or more electrical conductors are disposed between the first ballistic layer and the outer shell in a cavity formed between the first ballistic layer and the outer shell.

* * * * *